US007758435B2

(12) United States Patent
Henry et al.

(10) Patent No.: US 7,758,435 B2
(45) Date of Patent: Jul. 20, 2010

(54) AMUSEMENT WATER RIDES INVOLVING INTERACTIVE USER ENVIRONMENTS

(75) Inventors: Jeffery Wayne Henry, New Braunfels, TX (US); John Timothy Schooley, New Braunfels, TX (US)

(73) Assignee: Water Ride Concepts, Inc., New Braunfels, TX (US)

( * ) Notice: Subject to any disclaimer, the term of this patent is extended or adjusted under 35 U.S.C. 154(b) by 284 days.

(21) Appl. No.: 11/512,713

(22) Filed: Aug. 30, 2006

(65) Prior Publication Data

US 2007/0087850 A1 Apr. 19, 2007

Related U.S. Application Data

(60) Provisional application No. 60/713,705, filed on Sep. 2, 2005.

(51) Int. Cl.
*A63H 23/10* (2006.01)
*A63H 23/00* (2006.01)

(52) U.S. Cl. ..... 472/128; 472/13; 473/466

(58) Field of Classification Search ..... 472/116, 472/117, 128, 129, 13; 463/7, 52, 53; 473/466, 473/472, 479, 481, 483, 485, 487
See application file for complete search history.

(56) References Cited

U.S. PATENT DOCUMENTS

| | | | |
|---|---|---|---|
| 193,516 | A | 7/1877 | Johns |
| 419,860 | A | 1/1890 | Libbey |
| 435,227 | A | 8/1890 | Inglis |
| 485,624 | A | 11/1892 | Gardner |
| 536,441 | A | 3/1895 | Morris |
| 540,715 | A | 6/1895 | Butler |
| 548,256 | A | 10/1895 | Idler |

(Continued)

FOREIGN PATENT DOCUMENTS

| | | |
|---|---|---|
| BE | 543055 | 12/1955 |

(Continued)

OTHER PUBLICATIONS

AA51—International Search Report and Written Opinion for PCT/US06/15503 mailed Jul. 6, 2007.

(Continued)

*Primary Examiner*—Kien T Nguyen
(74) *Attorney, Agent, or Firm*—Meyertons, Hood, Kivlin, Kowert & Goetzel, P.C.; Eric B. Meyertons

(57) ABSTRACT

An interactive water amusement ride may include a water amusement ride, a competition area located in the water amusement ride, and a participant identifier coupled to a participant in the water amusement ride. The participant may participate in a competition in the competition area. An automated system assesses a status of the participant in the competition. In some embodiments, an automated system for an interactive water amusement ride includes sensors coupled to a competition area. The sensors may detect participant identifiers in the competition area. The sensors may be coupled to a control system. The control system may assess a status of each participant individually and/or a status of the teams in the competition area. Status of participants and/or teams in the competition area may be displayed on a display (e.g., a scoreboard) located at or near the competition area.

30 Claims, 13 Drawing Sheets

U.S. PATENT DOCUMENTS

| | | | |
|---|---|---|---|
| 552,713 | A | 1/1896 | Lenox |
| 555,049 | A | 2/1896 | Ogilbe |
| 566,182 | A | 8/1896 | Jackman |
| 570,016 | A | 10/1896 | Harman |
| 572,426 | A | 12/1896 | Idler |
| 576,704 | A | 2/1897 | Urch |
| 583,121 | A | 5/1897 | Pattee |
| 604,164 | A | 5/1898 | Wilde et al. |
| 610,548 | A | 9/1898 | Manny |
| 640,439 | A | 2/1900 | Boyton |
| 654,980 | A | 6/1900 | Howard |
| 664,179 | A | 12/1900 | Schofield |
| 665,765 | A | 1/1901 | Thompson |
| 689,114 | A | 12/1901 | Pape |
| 691,353 | A | 1/1902 | Carpenter et al. |
| 697,202 | A | 4/1902 | Donne |
| 697,891 | A | 4/1902 | Schrader |
| 714,717 | A | 12/1902 | LaPorte |
| 720,014 | A | 2/1903 | Folks |
| 724,040 | A | 3/1903 | Pusterla |
| 724,757 | A | 4/1903 | Symonds |
| 728,303 | A | 5/1903 | Roltair |
| 728,894 | A | 5/1903 | Folks |
| 741,964 | A | 10/1903 | Harlan |
| 743,968 | A | 11/1903 | Wilson |
| 744,880 | A | 11/1903 | Smith |
| 753,311 | A | 3/1904 | Pusterla |
| 753,449 | A | 3/1904 | Thompson |
| 754,698 | A | 3/1904 | Reed |
| 757,286 | A | 4/1904 | Du Clos |
| 760,503 | A | 5/1904 | Welsh |
| 762,566 | A | 6/1904 | Webster et al. |
| 764,675 | A | 7/1904 | Pfeiffer |
| 774,209 | A | 11/1904 | Stubbs |
| 774,274 | A | 11/1904 | Pusterla |
| 774,917 | A | 11/1904 | Maguire |
| 776,936 | A | 12/1904 | Pusterla |
| 779,464 | A | 1/1905 | Bruce |
| 783,425 | A | 2/1905 | Folks |
| 792,422 | A | 6/1905 | Kelly |
| 801,945 | A | 10/1905 | Welsh |
| 808,487 | A | 12/1905 | Stahl |
| 824,436 | A | 6/1906 | Pester |
| 828,689 | A | 8/1906 | Thompson |
| 831,149 | A | 9/1906 | Faller |
| 849,970 | A | 4/1907 | Boyton |
| 868,736 | A | 10/1907 | Washington |
| 869,432 | A | 10/1907 | Gin |
| 879,283 | A | 2/1908 | Mayberry et al. |
| 883,441 | A | 3/1908 | Andrews |
| 891,388 | A | 6/1908 | Visser et al. |
| 896,940 | A | 8/1908 | Rosen |
| 904,848 | A | 11/1908 | DeVore |
| 929,972 | A | 8/1909 | M'Giehan |
| 931,863 | A | 8/1909 | Haight |
| 952,673 | A | 3/1910 | Karr |
| 1,004,174 | A | 9/1911 | Kavakos |
| 1,056,929 | A | 3/1913 | Navarro |
| 1,062,838 | A | 5/1913 | Miller |
| 1,063,949 | A | 6/1913 | Bedient |
| 1,095,965 | A | 5/1914 | Glazier |
| 1,124,950 | A | 1/1915 | Reagen et al. |
| 1,158,295 | A | 10/1915 | Rodriguez |
| 1,159,519 | A | 11/1915 | Menier |
| 1,167,993 | A | 1/1916 | Guzendorfer |
| 1,195,707 | A | 8/1916 | Miller |
| 1,198,749 | A | 9/1916 | Myers |
| 1,230,559 | A | 6/1917 | Burke |
| 1,249,455 | A | 12/1917 | Myers |
| 1,320,124 | A | 10/1919 | Chrul |
| 1,378,635 | A | 5/1921 | Unger |
| 1,399,469 | A | 12/1921 | Cucullu |
| 1,417,570 | A | 5/1922 | Ridgway |
| 1,440,661 | A | 1/1923 | Dickinson |
| 1,441,126 | A | 1/1923 | Sherman et al. |
| 1,448,306 | A | 3/1923 | Lezert |
| 1,497,754 | A | 6/1924 | Howard |
| 1,520,217 | A | 12/1924 | Auperl |
| 1,540,635 | A | 6/1925 | Kohl |
| 1,551,249 | A | 8/1925 | Held |
| 1,563,855 | A | 12/1925 | Held |
| 1,591,566 | A | 6/1926 | Schmidt et al. |
| 1,601,483 | A | 9/1926 | Vaszin |
| 1,606,024 | A | 11/1926 | Gorhum et al. |
| 1,606,854 | A | 11/1926 | Vaszin |
| 1,607,771 | A | 11/1926 | Miller |
| 1,609,922 | A | 12/1926 | Wiig |
| 1,648,196 | A | 11/1927 | Rohmer |
| 1,763,976 | A | 6/1930 | Lippincott |
| 1,783,268 | A | 12/1930 | Traver |
| 1,849,226 | A | 3/1932 | Erban |
| 1,859,267 | A | 5/1932 | Kurz |
| 1,893,167 | A | 1/1933 | Glagolin |
| 1,926,780 | A | 9/1933 | Lippincott |
| 2,064,035 | A | 12/1936 | Rynearson |
| 2,146,631 | A | 2/1939 | Kish |
| 2,484,466 | A | 10/1949 | Rumler |
| 2,705,144 | A | 3/1955 | Ridgway |
| 2,738,885 | A | 3/1956 | Demaline |
| 2,888,205 | A | 5/1959 | Trucco |
| D190,127 | S | 4/1961 | Fowler |
| 2,991,726 | A | 6/1961 | Miller |
| 3,000,017 | A | 9/1961 | Skovira |
| 3,003,430 | A | 10/1961 | Hamel |
| 3,030,895 | A | 4/1962 | Hamel |
| 3,113,528 | A | 12/1963 | Morgan et al. |
| 3,114,333 | A | 12/1963 | Fowler et al. |
| 3,116,925 | A | 1/1964 | Welch |
| D204,282 | S | 4/1966 | Morgan |
| 3,302,413 | A | 2/1967 | Burnett |
| 3,340,635 | A | 9/1967 | McIntosh |
| 3,390,640 | A | 7/1968 | Couttet et al. |
| 3,404,635 | A | 10/1968 | Bacon et al. |
| 3,456,943 | A | 7/1969 | Brown |
| 3,473,334 | A | 10/1969 | Dexter |
| 3,508,405 | A | 4/1970 | Koch |
| 3,534,413 | A | 10/1970 | Plasseraud |
| 3,598,402 | A | 8/1971 | Frenzl |
| 3,690,265 | A | 9/1972 | Horibata |
| D229,354 | S | 11/1973 | Morgan |
| 3,827,387 | A | 8/1974 | Morgan |
| 3,830,161 | A | 8/1974 | Bacon |
| 3,853,067 | A | 12/1974 | Bacon |
| 3,861,514 | A | 1/1975 | Ling |
| 3,865,041 | A | 2/1975 | Bacon |
| 3,890,655 | A | 6/1975 | Mathis |
| 3,913,332 | A | 10/1975 | Forsman |
| 3,923,301 | A | 12/1975 | Myers |
| 3,930,450 | A | 1/1976 | Symons |
| 3,956,779 | A | 5/1976 | Jewett |
| 4,001,899 | A | 1/1977 | Mathis |
| 4,063,517 | A | 12/1977 | Nardozzi, Jr. |
| 4,073,722 | A | 2/1978 | Grutsch |
| 4,149,469 | A | 4/1979 | Bigler |
| 4,149,710 | A | 4/1979 | Rouchard |
| 4,175,361 | A | 11/1979 | Kumode |
| 4,194,733 | A | 3/1980 | Whitehouse, Jr. |
| 4,196,900 | A | 4/1980 | Becker et al. |
| 4,198,043 | A | 4/1980 | Timbes et al. |
| 4,205,785 | A | 6/1980 | Stanley |
| 4,221,170 | A | 9/1980 | Koudelka |
| 4,225,953 | A | 9/1980 | Simon et al. |
| 4,278,247 | A | 7/1981 | Joppe et al. |
| 4,299,171 | A | 11/1981 | Larson |

4,305,117 A 12/1981 Evans
4,337,704 A 7/1982 Becker et al.
4,376,404 A 3/1983 Haddad
D269,082 S 5/1983 Spieldiener
4,391,201 A 7/1983 Bailey
4,392,434 A 7/1983 Durwald et al.
4,423,864 A 1/1984 Wiik
4,429,867 A 2/1984 Barber
4,484,739 A 11/1984 Kreinbihl et al.
4,484,836 A 11/1984 Bailard
4,501,434 A 2/1985 Dupuis
4,516,943 A 5/1985 Spieldiener et al.
4,543,886 A 10/1985 Spieldiener et al.
4,545,574 A 10/1985 Sassak
4,545,583 A 10/1985 Pearman et al.
4,564,190 A 1/1986 Frenzl
4,576,512 A 3/1986 Combes et al.
4,683,686 A 8/1987 Ozdemir
4,696,251 A 9/1987 Spieldiener et al.
4,741,388 A 5/1988 Kuroiwa
4,759,545 A * 7/1988 Grable ..... 473/481
4,778,430 A 10/1988 Goldfarb et al.
4,783,861 A 11/1988 Leurent
4,792,260 A 12/1988 Sauerbier
4,797,027 A 1/1989 Combes et al.
4,805,896 A 2/1989 Moody
4,805,897 A 2/1989 Dubeta
4,817,312 A 4/1989 Fuller et al.
4,836,521 A 6/1989 Barber
4,850,896 A 7/1989 Smith et al.
4,854,256 A 8/1989 Hayashi
4,905,987 A 3/1990 Frenzi
4,939,358 A 7/1990 Herman et al.
4,954,014 A 9/1990 Sauerbier et al.
4,960,275 A 10/1990 Magon
4,963,057 A 10/1990 Fournier
4,979,679 A 12/1990 Downs
4,984,783 A 1/1991 Fujimaki
5,011,134 A 4/1991 Langford
5,011,161 A 4/1991 Galphin
5,020,465 A 6/1991 Langford
5,022,588 A 6/1991 Haase
5,033,392 A 7/1991 Schemitsch
5,069,387 A 12/1991 Alba
5,069,443 A 12/1991 Shiratori
5,073,082 A 12/1991 Radlik
5,092,268 A 3/1992 Taylor
5,115,908 A 5/1992 Williams
5,137,497 A 8/1992 Dubeta
5,143,107 A 9/1992 Kelley
5,152,210 A 10/1992 Chen
5,167,321 A 12/1992 Brodrick, Sr.
5,171,101 A 12/1992 Sauerbier et al.
5,183,437 A 2/1993 Millay et al.
5,194,048 A 3/1993 Briggs
5,213,547 A 5/1993 Lochtefeld
5,219,315 A 6/1993 Fuller et al.
5,224,652 A 7/1993 Kessler
5,230,662 A 7/1993 Langford
5,236,280 A 8/1993 Lochtefeld
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,320,362 A 6/1994 Bear et al.
5,387,158 A 2/1995 Bertrand
5,393,170 A 2/1995 Lochtefeld
5,401,117 A 3/1995 Lochtefeld
5,403,238 A 4/1995 Baxter et al.
5,405,294 A 4/1995 Briggs
5,421,451 A 6/1995 Easton
5,421,782 A 6/1995 Lochtefeld
5,426,899 A 6/1995 Jones
5,427,574 A 6/1995 Donnelly-Weide
5,433,671 A 7/1995 Davis
5,437,463 A 8/1995 Fromm
5,439,170 A 8/1995 Dach
5,452,678 A 9/1995 Simpkins
5,453,054 A 9/1995 Langford
5,461,876 A 10/1995 Dressler
5,473,233 A 12/1995 Stull et al.
5,478,281 A 12/1995 Forton
5,480,148 A 1/1996 Bartosik
5,482,510 A 1/1996 Ishii et al.
5,494,729 A 2/1996 Henry et al.
5,499,821 A * 3/1996 Rycroft ..... 273/357
5,503,597 A 4/1996 Lochtefeld et al.
5,513,470 A 5/1996 Vollebregt
5,536,210 A 7/1996 Barber
5,540,622 A 7/1996 Gold et al.
5,564,859 A 10/1996 Lochtefeld
5,564,984 A 10/1996 Mirabella et al.
5,581,954 A 12/1996 Vollebregt
5,613,443 A 3/1997 Ariga et al.
5,615,887 A 4/1997 Park
5,623,986 A 4/1997 Wiggs
5,628,584 A 5/1997 Lochtefeld
5,664,910 A 9/1997 Lochtefeld et al.
5,667,445 A 9/1997 Lochtefeld
5,678,956 A 10/1997 Freelain
5,685,778 A 11/1997 Sheldon et al.
5,690,582 A 11/1997 Ulrich et al.
5,698,839 A 12/1997 Jagielinski et al.
5,704,294 A 1/1998 Van Winkle et al.
5,716,282 A 2/1998 Ring et al.
5,732,635 A 3/1998 McKoy
5,735,742 A 4/1998 French
5,735,748 A 4/1998 Meyers et al.
5,738,590 A 4/1998 Lochtefeld
5,761,776 A 6/1998 Vollebregt
5,766,082 A 6/1998 Lochtefeld et al.
5,779,553 A 7/1998 Langford
5,785,592 A * 7/1998 Jacobsen ..... 463/7
5,791,254 A 8/1998 Mares et al.
5,809,701 A 9/1998 Vollebregt
5,813,952 A 9/1998 Lochbaum
5,816,314 A 10/1998 Wiggs et al.
5,820,471 A 10/1998 Briggs
5,860,364 A 1/1999 McKoy
5,864,623 A 1/1999 Messina et al.
5,872,594 A 2/1999 Thompson
5,902,983 A 5/1999 Crevelt et al.
5,923,364 A 7/1999 Rhodes et al.
5,927,478 A 7/1999 Archer
5,949,044 A 9/1999 Walker et al.
5,950,253 A 9/1999 Last
5,978,593 A 11/1999 Sexton
5,989,126 A 11/1999 Kilbert et al.
6,006,672 A 12/1999 Newfarmer et al.
6,012,832 A 1/2000 Saunders et al.
6,019,374 A 2/2000 Breeding
6,036,603 A 3/2000 Mason et al.
6,045,449 A 4/2000 Aragona et al.
6,075,442 A 6/2000 Welch
6,113,506 A * 9/2000 Nielsen ..... 473/466
6,115,974 A 9/2000 Milanian
6,139,382 A 10/2000 Eschbacher et al.
6,146,282 A 11/2000 McCready et al.
6,161,771 A 12/2000 Henry
6,162,127 A 12/2000 Ochi
6,178,692 B1 1/2001 Graven
6,183,362 B1 2/2001 Boushy
6,186,902 B1 2/2001 Briggs
6,195,851 B1 3/2001 Vollebregt et al.

| | | | |
|---|---|---|---|
| 6,206,782 | B1 | 3/2001 | Walker et al. |
| 6,210,287 | B1 | 4/2001 | Briggs |
| 6,234,900 | B1 | 5/2001 | Cumbers |
| 6,237,499 | B1 | 5/2001 | McKoy |
| 6,261,186 | B1 | 7/2001 | Henry |
| 6,265,977 | B1 | 7/2001 | Vega et al. |
| 6,272,695 | B1 | 8/2001 | Brandner |
| 6,280,326 | B1 | 8/2001 | Saunders |
| 6,280,328 | B1 | 8/2001 | Holch et al. |
| 6,280,342 | B1 | 8/2001 | Tod |
| 6,302,793 | B1 | 10/2001 | Fertitta, III et al. |
| 6,336,771 | B1 | 1/2002 | Hill |
| 6,340,331 | B1 | 1/2002 | Saunders et al. |
| 6,347,738 | B1 | 2/2002 | Crevelt et al. |
| 6,354,955 | B1 | 3/2002 | Stuart et al. |
| 6,362,778 | B2 | 3/2002 | Neher |
| 6,371,717 | B1 | 4/2002 | Grams et al. |
| 6,375,578 | B1 | 4/2002 | Briggs |
| 6,384,409 | B1 | 5/2002 | Libbey, III et al. |
| 6,409,595 | B1 | 6/2002 | Uihlein et al. |
| 6,413,191 | B1 | 7/2002 | Harris et al. |
| 6,424,264 | B1 | 7/2002 | Giraldin et al. |
| 6,460,852 | B1 | 10/2002 | Tallian |
| 6,463,416 | B1 | 10/2002 | Messina |
| 6,471,590 | B2 | 10/2002 | Saunders |
| 6,474,557 | B2 | 11/2002 | Mullins et al. |
| 6,475,088 | B1 | 11/2002 | Jones et al. |
| 6,475,095 | B1 | 11/2002 | Henry |
| 6,485,368 | B2 | 11/2002 | Jones et al. |
| 6,488,590 | B2 | 12/2002 | Katayama |
| 6,503,146 | B2 | 1/2003 | Walker et al. |
| 6,508,710 | B1 | 1/2003 | Paravia et al. |
| 6,511,377 | B1 | 1/2003 | Weiss |
| 6,513,284 | B1 | 2/2003 | Sandlin |
| 6,533,191 | B1 | 3/2003 | Berger et al. |
| 6,539,101 | B1 | 3/2003 | Black |
| 6,540,609 | B1 | 4/2003 | Paige |
| 6,547,131 | B1 | 4/2003 | Foodman et al. |
| 6,547,664 | B2 | 4/2003 | Saunders |
| 6,553,336 | B1 | 4/2003 | Johnson et al. |
| 6,554,705 | B1 | 4/2003 | Cumbers |
| 6,558,256 | B1 | 5/2003 | Saunders |
| 6,561,914 | B2 | 5/2003 | Henry |
| 6,569,023 | B1 | 5/2003 | Briggs |
| 6,595,857 | B2 | 7/2003 | Soltys et al. |
| 6,601,771 | B2 | 8/2003 | Charrin |
| 6,604,327 | B1 | 8/2003 | Reville |
| 6,629,019 | B2 | 9/2003 | Legge et al. |
| 6,634,942 | B2 | 10/2003 | Walker et al. |
| 6,634,949 | B1 * | 10/2003 | Briggs et al. ..... 463/42 |
| 6,663,006 | B2 | 12/2003 | Mullins et al. |
| 6,663,490 | B2 | 12/2003 | Soltys et al. |
| 6,678,401 | B2 | 1/2004 | Jones et al. |
| 6,699,124 | B2 | 3/2004 | Suchocki |
| 6,702,687 | B1 | 3/2004 | Henry |
| 6,708,706 | B1 | 3/2004 | Robinson |
| 6,712,696 | B2 | 3/2004 | Soltys et al. |
| 6,722,985 | B2 | 4/2004 | Criss-Puszkiewicz et al. |
| 6,729,956 | B2 | 5/2004 | Wolf et al. |
| 6,729,959 | B1 | 5/2004 | Moore et al. |
| 6,743,098 | B2 | 6/2004 | Urie et al. |
| 6,747,562 | B2 | 6/2004 | Giraldin et al. |
| 6,755,741 | B1 | 6/2004 | Rafaeli |
| 6,758,231 | B1 | 7/2004 | Lochtefeld et al. |
| 6,758,751 | B2 | 7/2004 | Soltys et al. |
| 6,761,637 | B2 | 7/2004 | Weston et al. |
| 6,773,355 | B1 | 8/2004 | Lekhtman |
| 6,776,715 | B2 | 8/2004 | Price |
| 6,786,824 | B2 | 9/2004 | Cannon |
| 6,789,608 | B1 | 9/2004 | Wiggs |
| 6,796,492 | B1 | 9/2004 | Gatto |
| 6,796,908 | B2 | 9/2004 | Weston |
| 6,811,486 | B1 | 11/2004 | Luciano, Jr. |
| 6,811,488 | B2 | 11/2004 | Paravia et al. |
| 6,814,667 | B2 | 11/2004 | Jeffway, Jr. et al. |
| 6,830,146 | B1 | 12/2004 | Scully et al. |
| 6,832,958 | B2 | 12/2004 | Acres et al. |
| 6,843,412 | B1 | 1/2005 | Sanford |
| 6,848,994 | B1 | 2/2005 | Knust et al. |
| 6,851,607 | B2 | 2/2005 | Orus et al. |
| 6,890,260 | B2 | 5/2005 | Ollins |
| 6,892,182 | B1 | 5/2005 | Rowe et al. |
| 6,896,616 | B2 | 5/2005 | Weiss |
| 6,896,619 | B2 | 5/2005 | Baltz et al. |
| 6,898,299 | B1 | 5/2005 | Brooks |
| 6,976,434 | B2 | 12/2005 | Roig et al. |
| 7,004,847 | B2 | 2/2006 | Henry |
| 7,029,400 | B2 | 4/2006 | Briggs |
| 7,179,173 | B2 | 2/2007 | Henry et al. |
| 7,229,359 | B2 | 6/2007 | Henry et al. |
| 7,285,053 | B2 | 10/2007 | Henry et al. |
| 7,371,182 | B2 | 5/2008 | Henry et al. |
| 7,371,183 | B2 | 5/2008 | Henry et al. |
| 2002/0072317 | A1 | 6/2002 | Livingston et al. |
| 2002/0082097 | A1 | 6/2002 | Henry et al. |
| 2003/0203760 | A1 | 10/2003 | Henry et al. |
| 2005/0034768 | A1 | 2/2005 | Henry et al. |
| 2005/0085306 | A1 | 4/2005 | Henry et al. |
| 2005/0090318 | A1 | 4/2005 | Henry et al. |
| 2005/0090319 | A1 | 4/2005 | Henry et al. |
| 2005/0090320 | A1 | 4/2005 | Henry et al. |
| 2005/0090321 | A1 | 4/2005 | Henry et al. |
| 2005/0090322 | A1 | 4/2005 | Henry et al. |
| 2005/0288111 | A1 | 12/2005 | Cowan et al. |
| 2006/0052171 | A1 | 3/2006 | Henry et al. |
| 2006/0111195 | A1 | 5/2006 | Henry |
| 2006/0111196 | A1 | 5/2006 | Henry |
| 2006/0135274 | A1 | 6/2006 | Henry |
| 2006/0142090 | A1 | 6/2006 | Henry |
| 2006/0178222 | A1 | 8/2006 | Henry et al. |
| 2006/0214805 | A1 | 9/2006 | Boujon |
| 2006/0258471 | A1 | 11/2006 | Briggs et al. |

FOREIGN PATENT DOCUMENTS

| | | |
|---|---|---|
| DE | 893778 | 10/1953 |
| DE | 4243812 A1 | 6/1994 |
| DE | 129145 | 1/2007 |
| EP | 1318864 | 11/2005 |
| EP | 1604712 | 12/2005 |
| WO | 92/03201 | 3/1992 |
| WO | 92/04087 | 3/1992 |
| WO | 97/33668 | 9/1997 |
| WO | 98/45006 | 10/1998 |
| WO | 01/10184 | 2/2001 |
| WO | 02/22226 | 3/2002 |
| WO | 02/22227 | 3/2002 |
| WO | 2005/042124 | 5/2005 |
| WO | 2006/057970 | 6/2006 |
| WO | 2006/113936 | 10/2006 |
| WO | 2007/019278 | 2/2007 |
| WO | 2007/027841 | 3/2007 |
| WO | 2007/028042 | 3/2007 |
| WO | 2007/028043 | 3/2007 |
| WO | 2007/035524 | 3/2007 |
| WO | 2007/106717 | 9/2007 |

OTHER PUBLICATIONS

AA52—International Search Report and Written Opinion for PCT/US06/34264 mailed Jul. 24, 2007.

AA41—Exhibits related to the "Mountain Slidewinder" ride.

Office Action for U.S. Appl. No. 11/244,866 mailed on Mar. 26, 2008, available in PAIR.

Office Action for U.S. Appl. No. 11/244,869 mailed on Apr. 8, 2008, available in PAIR.

Office Action for U.S. Appl. No. 11/215,747 mailed on Mar. 18, 2008, available in PAIR.
Office Action for U.S. Appl. No. 11/215,795 mailed on Mar. 17, 2008, available in PAIR.
Office Action for U.S. Appl. No. 11/218,330 mailed on Mar. 25, 2008, available in PAIR.
Office Action for U.S. Appl. No. 11/283,503 mailed on Mar. 28, 2008, available in PAIR.
Office Action for U.S. Appl. No. 11/513,338 mailed on Jun. 12, 2008, available in PAIR.
Office Action for U.S. Appl. No. 11/407,862 mailed on Aug. 27, 2008, available in PAIR.
Office Action for U.S. Appl. No. 11/407,885 mailed on Sep. 5, 2008, available in PAIR.
Office Action for U.S. Appl. No. 11/244,866 mailed on Feb. 24, 2009, available in PAIR.
Office Action for U.S. Appl. No. 11/244,869 mailed on Apr. 14, 2009, available in PAIR.
Office Action for U.S. Appl. No. 11/407,861 mailed on Mar. 12, 2009, available in PAIR.
Office Action for U.S. Appl. No. 11/407,845 mailed on Apr. 16, 2009, available in PAIR.
Office Action for U.S. Appl. No. 11/215,795 mailed on Feb. 26, 2009, available in PAIR.
Office Action for U.S. Appl. No. 11/218,330 mailed on Mar. 20, 2009, available in PAIR.
Office Action for U.S. Appl. No. 11/283,503 mailed on Mar. 10, 2009, available in PAIR.
Office Action for U.S. Appl. No. 11/215,747 mailed on May 18, 2009, available in PAIR.
Co-Pending U.S. Appl. No. 11/407,862 entitled, "Composite Tree" to Henry et al. filed Apr. 20, 2006; available in private PAIR.
Co-Pending U.S. Appl. No. 11/407,861 entitled, "Tree With Elevated Structure" to Henry et al. filed Apr. 20, 2006; available in private PAIR.
Co-Pending U.S. Appl. No. 11/407,875 entitled, "Water Amusement System With Elevated Structure" to Henry et al. filed Apr. 20, 2006; available in private PAIR.
Co-Pending U.S. Appl. No. 11/407,874 entitled, "Thematic Tree System" to Henry et al. filed Apr. 20, 2006; available in private PAIR.
Co-Pending U.S. Appl. No. 11/407,886 entitled, "Water Amusement System With Trees" to Henry et al. filed Apr. 20, 2006; available in private PAIR.
Co-Pending U.S. Appl. No. 11/407,845 entitled, "Lift Apparatus for Base-Mounted Plant" to Henry et al. filed Apr. 20, 2006; available in private Pair.
Co-Pending U.S. Appl. No. 11/407,885 entitled, "Tree With Covering Apparatus" to Henry et al. filed Apr. 20, 2006; available in private PAIR.
Co-Pending U.S. Appl. No. 11/512,709 entitled, "Methods and Systems for Self-Contained Floating Marine Parks" to Henry et al. filed Aug. 30, 2006; available in private PAIR.
Co-Pending U.S. Appl. No. 11/513,314 entitled, "Methods and Systems for Active Filtration of Portions of Self-Contained Floating Marine Parks" to Henry et al. filed Aug. 30, 2006; available in private PAIR.
Co-Pending U.S. Appl. No. 11/11/512,708 entitled, "Water Amusement System and Method Including a Self-Contained Floating Marine Park" to Henry et al. filed Aug. 30, 2006; available in private PAIR.
Co-Pending U.S. Appl. No. 11/513,315 entitled, "Methods and Systems for Positionable Screen for Self-Contained Floating Marine Parks" to Henry et al. filed Aug. 30, 2006; available in private PAIR.
Co-Pending U.S. Appl. No. 11/513,338 entitled, "Methods and Systems for Thermal Control Systems for Self-Contained Floating Marine Parks" to Henry et al. filed Aug. 30, 2006; available in private PAIR.
Co-Pending U.S. Appl. No. 11/512,737 entitled, "Methods and Systems for Modular Self-Contained Floating Marine Parks" to Henry et al. filed Aug. 30, 2006; available in private PAIR.
Co-Pending U.S. Appl. No. 11/215,357 entitled, "Methods and Systems for Amusement Park ConveyorS" to Henry et al. filed Aug. 30, 2005; available in private PAIR.
Co-Pending U.S. Appl. No. 11/215,736 entitled, "Water Amusement Park Conveyor Barriers" to Henry et al. filed Aug. 30, 2005; available in private PAIR.
Co-Pending U.S. Appl. No. 11/215,747 entitled, "Adjusting Participant Flow Rate in Water Amusement ParkS" to Henry et al. filed Aug. 30, 2005; available in private PAIR.
Co-Pending U.S. Appl. No. 11/215,795 entitled, "Modular Water Amusement Park Conveyors" to Henry et al. filed Aug. 30, 2005; available in private PAIR.
Co-Pending U.S. Appl. No. 11/215,351 entitled, "Water Amusement Park Conveyor Support Elements" to Henry et al. filed Aug. 30, 2005; available in private PAIR.
Co-Pending U.S. Appl. No. 11/244,864 entitled, "Water Amusement Park Water Channel Flow System" to Henry et al. filed Oct. 6, 2005; available in private PAIR.
Co-Pending U.S. Appl. No. 11/244,872 entitled, "Water Amusement Park Water Channel and adjustable Flow Controller" to Henry et al. filed Oct. 6, 2005; available in private PAIR.
Co-Pending U.S. Appl. No. 11/512,713 entitled, "Water Circuit Interactive Games, Exercise, and Gambling" to Henry et al. filed Aug. 30, 2006; available in private PAIR.
Co-Pending U.S. Appl. No. 11/512,710 entitled, "Amusement Water Rides Involving Exercise Circuit" to Henry et al. filed Aug. 30, 2006; available in private PAIR.
Co-Pending U.S. Appl. No. 11/522,056 entitled, "Amusement Water Rides Involving Games of Chance" to Henry et al. filed Sep. 15, 2006; available in private PAIR.
Co-Pending U.S. Appl. No. 11/375,361 entitled, "Method and System of Positionable Covers for Water Amusement Parks" to Henry et al. filed Mar. 14, 2006; available in private PAIR.
Co-Pending U.S. Appl. No. Unknown entitled, "Continuous Water Ride Method and System for Water Amusement Parks" to Henry et al. filed Dec. 8, 2006; available in private PAIR.
Office Action for U.S. Appl. No. 11/244,866 mailed on Jun. 26, 2009, available in PAIR.
Office Action for U.S. Appl. No. 11/407,862 mailed on Jun. 24, 2009, availaible in PAIR.
Office Action for U.S. Appl. No. 11/215,795 mailed on Jun. 23, 2009, available in PAIR.
Office Action for U.S. Appl. No. 11/407,874 mailed on Jul. 14, 2009, available in PAIR.
Office Action for U.S. Appl. No. 11/407,886 mailed on Jul. 13, 2009, available in PAIR.
Office Action for U.S. Appl. No. 11/513,338 mailed on Aug. 21, 2009, available in PAIR.
Office Action for U.S. Appl. No. 11/218,330 mailed on Jul. 22, 2009, available in PAIR.
Office Action for U.S. Appl. No. 11/283,503 mailed on Aug. 13, 2009, available in PAIR.
AA18—Rorres, C. "The Turn of the Screw: Optimal Design of an Archimedes Screw" J. of Hydraulic Engineering, Jan. 2000, vol. 126, No. 1, pp. 72-80.
AA21—Office Action for U.S. Appl. No. 10/693,654 mailed on Dec. 7, 2004.
AA22—Office Action for U.S. Appl. No. 10/693,654 mailed on Jun. 10, 2005.
AA34—Office Action for U.S. Appl. No. 10/985,178 mailed on Apr. 20, 2005.
AA35—Office Action for U.S. Appl. No. 10/985,178 mailed on Oct. 3, 2005.
AA36—Office Action for U.S. Appl. No. 10/985,178 mailed on May 18, 2006.
AA33—Office Action for U.S. Appl. No. 09/952,036 mailed on Feb. 9, 2006.
AA23—International Search Report for PCT/US01/28542 mailed Mar. 27, 2002.
AA24—Written Opinion for PCT/US01/28542 mailed May 2, 2002.
AA25—Written Opinion for PCT/US01/28542 issued Aug. 5, 2002.
AA26—International Preliminary Examination Report for PCT/US01/28542 issued Dec. 2, 2002.
AA27—Written Opinion for 01 970 881.7—2307 mailed Apr. 13, 2004.

AA28—Written Opinion for 01 970 881.7—2307 mailed Oct. 21, 2004.
AA30—European Search Report for EP 05019093.3 mailed Oct. 28, 2005.
AA14—International Search Report for PCT/US01/28535 mailed Mar. 27, 2002.
AA15—Written Opinion for PCT/US01/28535 mailed May 2, 2002.
AA16—Written Opinion for PCT/US01/28535 mailed Aug. 6, 2002.
AA17—International Preliminary Examination Report for PCT/US01/28535 issued Jan. 13, 2003.
AA38—Exhibits related to the "Gravity Groove" slide (Sep. 1995).
AA29—Engineering drawing (as well as photographs of the finished product) for the Silver Dollar City water slide in Branson, Missouri, the date is unknown, however there is a 1986 copyright on the engineering drawing.
Office Action for U.S. Appl. No. 11/244,866 mailed on Oct. 21, 2009, available in PAIR.
Office Action for U.S. Appl. No. 11/407,862 mailed on Nov. 30, 2009, availaible in PAIR.
Office Action for U.S. Appl. No. 11/407,861 mailed on Oct. 15, 2009, availaible in PAIR.
Office Action for U.S. Appl. No. 11/407,874 mailed on Dec. 1, 2009, available in PAIR.
Office Action for U.S. Appl. No. 11/407,886 mailed on Nov. 18, 2009, available in PAIR.
Office Action for U.S. Appl. No. 11/407,845 mailed on Oct. 16, 2009, availaible in PAIR.
Office Action for U.S. Appl. No. 11/407,885 mailed on Dec. 2, 2009, availaible in PAIR.
Office Action for U.S. Appl. No. 11/513,338 mailed on Dec. 10, 2009, available in PAIR.
Office Action for U.S. Appl. No. 11/215,747 mailed on Oct. 23, 2009, available in PAIR.
Office Action for U.S. Appl. No. 11/215,795 mailed on Nov. 18, 2009, available in PAIR.
Advisory Action for U.S. Appl. No. 11/218,330 mailed on Nov. 9, 2009, available in PAIR.

* cited by examiner

AMUSEMENT WATER RIDES INVOLVING INTERACTIVE USER ENVIRONMENTS

PRIORITY CLAIM

This patent application claims priority to U.S. Provisional Patent Application Ser. No. 60/713,705 entitled "AMUSEMENT WATER RIDES INVOLVING INTERACTIVE USER ENVIRONMENTS" filed on Sep. 2, 2005, the disclosure of which is hereby incorporated by reference.

BACKGROUND OF THE INVENTION

1. Field of the Invention

The present disclosure generally relates to water amusement attractions and rides. More particularly, the disclosure generally relates to water-powered rides and to a system and method in which participants may be actively involved in water rides that involve interactive games.

2. Description of the Relevant Art

The 80's decade has witnessed phenomenal growth in the participatory family water recreation facility, i.e., the waterpark, and in water oriented ride attractions in the traditional themed amusement parks. The main current genre of water ride attractions, e.g., waterslides, river rapid rides, and log flumes, and others, require participants to walk or be mechanically lifted to a high point, wherein, gravity enables water, rider(s), and riding vehicle (if appropriate) to slide down a chute or incline to a lower elevation splash pool, whereafter the cycle repeats. Some rides can move riders uphill and downhill but for efficiency and performance reasons these rides also generally start on an elevated tower and generally require walking up steps to reach the start of the ride.

With this phenomenal growth came the subsequent problem of finding enough appropriate land available for development in water recreation facilities. One of the problems facing waterpark developers if finding enough land upon which to develop their waterparks. The development of waterparks is an expensive enterprise to which the addition of having to purchase large tracts of land only further adds to the expense of developing waterparks.

Generally speaking, the traditional downhill water rides are short in duration (normally measured in seconds of ride time) and have limited throughput capacity. The combination of these two factors quickly leads to a situation in which patrons of the parks typically have long queue line waits of up to two or three hours for a ride that, although exciting, lasts only a few seconds. Additional problems like hot and sunny weather, wet patrons, and other difficulties combine to create a very poor overall customer feeling of satisfaction or perceived entertainment value in the waterpark experience. Poor entertainment value in waterparks as well as other amusement parks is rated as the biggest problem of the waterpark industry and is substantially contributing to the failure of many waterparks and threatens the entire industry.

Additionally, none of the typical downhill waterpark rides is specifically designed to transport guests between rides. In large amusement parks transportation between rides or areas of the park may be provided by a train or monorail system, or guests are left to walk from ride to ride or area to area. These forms of transportation have relatively minor entertainment value and are passive in nature in that they have little if any active guest-controlled functions such as choice of pathway, speed of riders or rider activity besides sightseeing from the vehicle. They are also generally unsuitable for waterparks because of their high installation and operating costs and have poor ambience within the parks. These types of transportation are also unsuitable for waterpark guests who, because of the large amount of time spent in the water, are often wet and want to be more active because of the combination of high ambient temperatures in summertime parks and the normal heat loss due to water immersion and evaporative cooling. Water helps cool guests and encourages a higher level of physical activity. Guests also want to stay in the water for fun. Waterparks are designed around the original experience of a swimming hole combined with the new sport of river rafting or tubing. The preferred feeling is one of natural ambience and organic experience. A good river ride combines calm areas and excitement areas like rapids, whirlpools, and beaches. Mechanical transportation systems do not fit in well with these types of rides. There exists a need in waterparks for a means of transportation through the park and between the rides.

For water rides that involve the use of a floatation device (e.g., an inner tube or floating board) the walk back to the start of a ride may be particularly arduous since the rider must usually carry the floatation device from the exit of the ride back to the start of the ride. Floatation devices could be transported from the exit to the entrance of the ride using mechanical transportation devices, but these devices are expensive to purchase and operate. Both of these processes reduce guest enjoyment, cause excess wear and tear on the floatation devices, contributes to guest injuries, and makes it impossible for some guests to access the rides. Also, a park that includes many different non-integrated rides may require guests to use different floatation devices for different rides, which makes it difficult for the park operators to provide the guests with a general purpose floatation device. It is advantageous to standardize riding vehicles for rides as much as possible.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

Typically waterparks are quite large in area. Typically guests must enter at one area and pass through a changing room area upon entering the park. Rides and picnic areas located in areas distant to the entry area are often underused in relation to rides and areas located near the entry area. More popular rides are overly filled with guests waiting in queue lines for entry onto them. This leads to conditions of overcrowding in areas of the park which leads to guest dissatisfaction and general reduction of optimal guest dispersal throughout the park. The lack of an efficient transportation system between rides accentuates this problem in waterparks.

SUMMARY

Various systems and methods for providing water amusement and related activities and entertainment are disclosed. In an embodiment, an interactive water amusement ride includes a water amusement ride, a competition area located in the water amusement ride, and a participant identifier coupled to a participant in the water amusement ride. The participant participates in a competition in the competition area. An automated system assesses a status of the participant in the competition. In certain embodiments, the participant identifiers may be radio-frequency transmitting identifiers.

In some embodiments, an automated system for an interactive water amusement ride includes sensors coupled to a competition area. The sensors may detect participant identifiers in the competition area. The sensors may be coupled to a control system. The control system may use information from the sensors to assess a status of the participant in the competition. In certain embodiments, a control system may include cameras to monitor participant in the competition areas.

In some embodiments, a competition area coupled to a water amusement ride may include objectives for participants to attempt. In certain embodiments, the objectives may require that a participant perform test of physical skill. For example, an objective may require a participant to direct an object into an opening (e.g., shooting a ball through a hoop), striking a target, or knocking down objects (e.g., bowling pins). In some embodiments, the objectives may include objective identifiers. Sensors coupled to a control system may detect the objective identifiers.

In an embodiment, an objective includes a first opening that accepts objects directed to the opening by the participant. The first opening is coupled to a second opening downstream from the first opening. Objects are transported from the first opening to the second opening. The participant retrieves the objects from the second opening.

In certain embodiments, an interactive game includes a competition area. A competition area may be part of a water ride. In certain embodiments, a competition area includes a body of water. For example, a competition area may include a channel of water that runs in a continuous loop or a basin filled with water. In certain embodiments, a competition area includes one entry point and one exit point for participants. In some embodiments, a competition area may include more than one entry point and/or more than one exit point for participants. In some embodiments, a competition area is coupled to a water amusement system (e.g., the entry and exit points of the competition area are coupled to the water amusement system). For example, a competition area may be coupled to a floating river system.

In certain embodiments, a participant identifier is coupled to a participant in a competition area. The participant identifier may include, for example, a radio-frequency transmitting identifier. The participant identifier may be detected by one or more sensors coupled to the competition area. The participant identifier may be used to assess a status of a participant in the competition area. The status of a participant in a competition area may include a status of the participant in a competition. For example, the status of the participant in the competition may include, but not be limited to, a location of the participant, a score of the participant in the competition, a period of time for the participant in the competition area, or a status of the participant relative to other participants in the competition area.

A status of a participant in a competition area may be assessed by an automated system. In certain embodiments, an automated system includes a control system and one or more sensors. The control system may be coupled to the one or more sensors in the competition area. In certain embodiments, the control system assesses the status of a plurality of participants in the competition area. In some embodiments, the plurality of participants may be competing against each other as individuals. In some embodiments, the plurality of participants may be divided into two or more teams competing against each other. The control system may assess a status of each participant individually and/or a status of the teams in the competition area. Status of participants and/or teams in the competition area may be displayed on a display (e.g., a scoreboard) located at or near the competition area.

In some embodiments, one or more cameras may be coupled to the control system. The cameras may be used to monitor the participant in the competition area. In some embodiments, the cameras are coupled to one or more sensors used to assess a status of a participant in the competition area. In some embodiments, the cameras are sensors used to assess a status of a participant in the competition area.

In certain embodiments, one or more participants in a competition area may participate in a competition. A competition may include one or more objectives for the participant to attempt. Examples of objectives include, but are not limited to, directing one or more balls through one or more openings (e.g., hoops) in the competition area, hitting one or more targets in the competition area, knocking down one or more pins in a set of pins using an object (e.g., a ball), or other physical tests of skill. In some embodiments, an objective includes an objective identifier that is detected by one or more sensors in the competition area. The objective identifier may be used to assess a status of the objective before, during, or after the objective is attempted by a participant. In some embodiments, the objective identifier may include an electronic scoring system used in conjunction with the objective. For example, the objective identifier may include an electronic means for scoring a hit on a target or a ball going through an opening. The objective identifier may be used in combination with a participant identifier to assess a status (e.g., a score) of the participant in a competition.

In an embodiment, participant identifiers are coupled to two or more participants in a water amusement ride. A sensor is coupled to the water amusement ride. The area associated with the sensor may include an interactive game. The sensor detects the participant identifiers. A control system may be coupled to the sensor. The control system may assess the progress of an aptitude of the participants in the interactive game. In some embodiments, an interactive game includes an opening that accepts an object thrown by the participants. The object may include an identifier. The control system may keep score for a specified period of time.

In an embodiment, an interactive water competition system includes a competition area with a body of water. At least two teams of participants compete with each other. The teams attempt objectives in the competition area. A participant identifier is coupled to each participant. A system assesses status of the competition between the teams. In one embodiment, the system is an automated system. In some embodiments, sensors coupled to the competition area detect the participant identifiers in the competition area. The sensors may be coupled to control system. The control system may assess a status of the participants in the competition. In one embodiment, referees may monitor the competition.

In some embodiments, participants on a team move through the competition area on flotation devices. In one embodiment, a body of water for a competition area includes a channel of water that runs in a continuous loop. In another embodiment, the body of water includes a basin filled with water. The competition area may be coupled to a water amusement system.

In an embodiment, a system for providing water amusement includes a body of water and a game control system. The game control system may include a processing unit that processes data relating to an interactive game. A display may be coupled to the processing unit. The display may receive data from the processing unit and display the data to at least one participant of the interactive game while the participant is in the body of water. The processing unit is configured to generate instructions to participants of the water amusement ride. In certain embodiments, a game control system may include control device operable by a participant to control play of the interactive game.

In certain embodiments, a processing unit for a game control system may generate information for use in a role-playing game. In one embodiment, the processing unit may be an automatic gamemaster for the role-playing game (e.g., fantasy game). The gamemaster may assign roles to participants of the game and establish objectives for the game. The processing unit may transmit scores, instructions, rules, game status, and other information to a display. In certain embodiments, a processing unit may process information received from participants (e.g., answers to questions posed to the participants through the displays) to control or measure the progress of a game. In certain embodiments, a processing unit is configured to randomly generate an element of data for use in the interactive game (e.g., randomly assign a team to go down a left water channel instead of a right water channel).

In some embodiments, a game control system includes sensors. The sensors may detect participant identifiers coupled to participants of the water ride and objective identifiers coupled to objectives. The processing unit may use information from the sensors to assess progress of the game and determine subsequent instructions. In certain embodiments, the game control system may include a control unit. The processing unit may provide signals to the control unit to operate devices on a water ride. For example, the processing unit may provide signals to the control unit to open a gate on the water ride.

In one embodiment, a game control system may direct a competition between participants or teams of participants. The processing unit may process data received from the sensors to assess a status of the participants. In certain embodiments, the processing unit may modify the outcome of one participant of the game based on the status of another participant.

BRIEF DESCRIPTION OF THE DRAWINGS

Advantages of the present invention may become apparent to those skilled in the art with the benefit of the following detailed description of the preferred embodiments and upon reference to the accompanying drawings in which.

Figure 1:
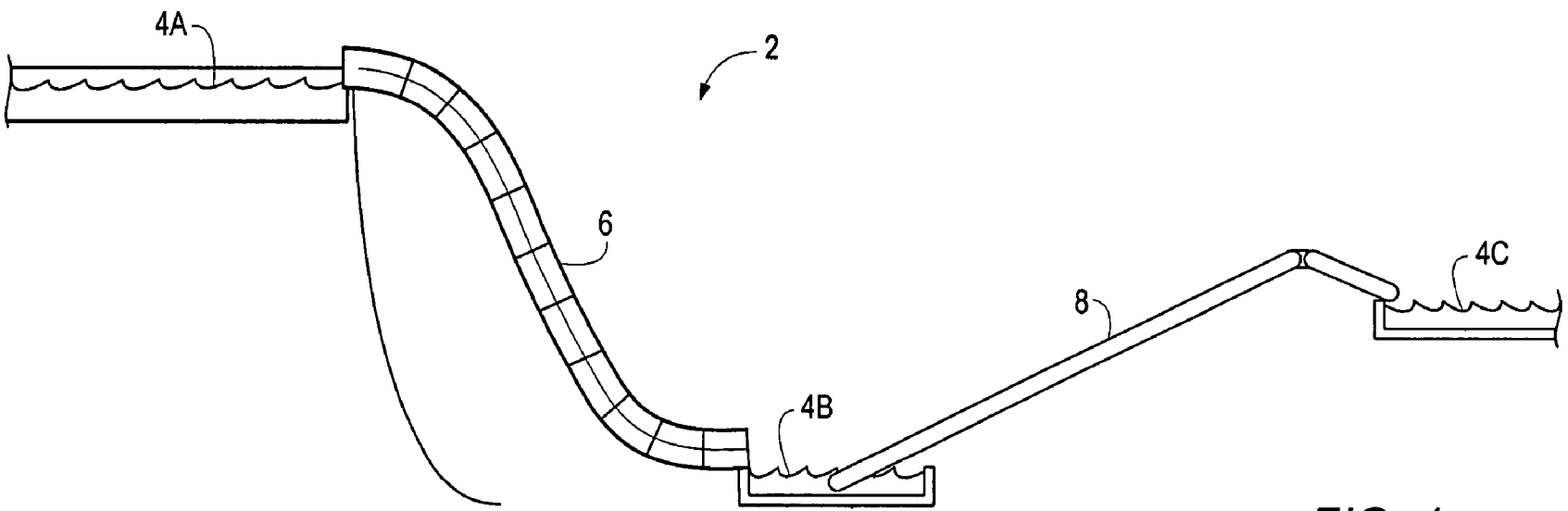
FIG. 1 depicts an embodiment of a portion of a continuous water slide.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In some embodiments, a water amusement system (e.g., a waterpark) may include a "continuous water ride." The continuous water ride may allow a participant using the continuous water ride to avoid long lines typically associated with many water amusement systems. Long lines and/or wait times are one of greatest problems associated with water amusement systems in the area of customer satisfaction.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

The concept of a continuous water ride was developed to address the problems and issues stated above associated with water amusement parks. Continuous water rides may assist in eliminating and/or reducing many long queue lines. Continuous water rides may eliminate and/or reduce participants having to walk back up to an entry point of a water ride. Continuous water rides may also allow the physically handicapped or physically challenged to take advantage of water amusement parks. Where before that may have been difficult if not impossible due to many flights of stairs typically associated with water amusement parks.

In some embodiments, continuous water rides may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and/or accelerator sections in water slides. Connections may reduce long queue lines normally associated with individual water rides. Connections may allow participants to remain in the water and/or a vehicle (e.g., a floatation device) during transportation from a first portion of the continuous water ride to a second portion of the continuous water ride.

In some embodiments, an exit point of a first water ride may be connected to an entry point of a second water ride forming at least a portion of a continuous water ride. The exit point of the first water ride and the entry point of the second water ride may be at different elevation levels. An elevation system may be used to connect the exit point of the first water ride and the entry point of the second water ride. In some embodiments, an entry point of a second water ride may have a higher elevation than an exit point of a first water ride coupled to the entry point of the second water ride.

In some embodiments, elevation systems may include any system capable of transporting one or more participants and/or one or more vehicles from a first point at one elevation level to a second point at a different elevation level. Elevation systems may include a conveyor belt system. Elevation systems may include a water lock system. Elevation systems may include an uphill water slide, a spiral transport system, and/or a water wheel.

FIG. 1 depicts an embodiment of at least a portion of continuous water ride 2. Continuous water ride 2 may include body of water 4A. Body of water 4A may include pools, lakes, and/or wells. Body of water 4A may be natural, artificial, or an artificially modified natural body of water. A non-limiting example of an artificially modified natural body of water might include a natural lake which has been artificially enlarged and adapted for water amusement park purposes (e.g., entry ladders and/or entry steps). Continuous water ride 2 may include downhill water slide 6. Downhill water slide 6 may convey participants from body of water 4A at a first elevation to a lower second elevation into typically some type of water container (e.g., body of water, channel, floating queue line, and/or pool). The water container at the lower second elevation may include, for illustrative purposes only, second body of water 4B (e.g., a pool). Continuous water ride 2 may include elevation system 8. Elevation system 8 may include any system capable of safely moving participants and/or vehicles from a lower elevation to a higher elevation. Elevation system 8 is depicted as a conveyor belt system in FIG. 1. Elevation system 8 may convey participants to body of water 4C. FIG. 1 depicts merely a portion of one embodiment of continuous water ride 2.

Figure 2:
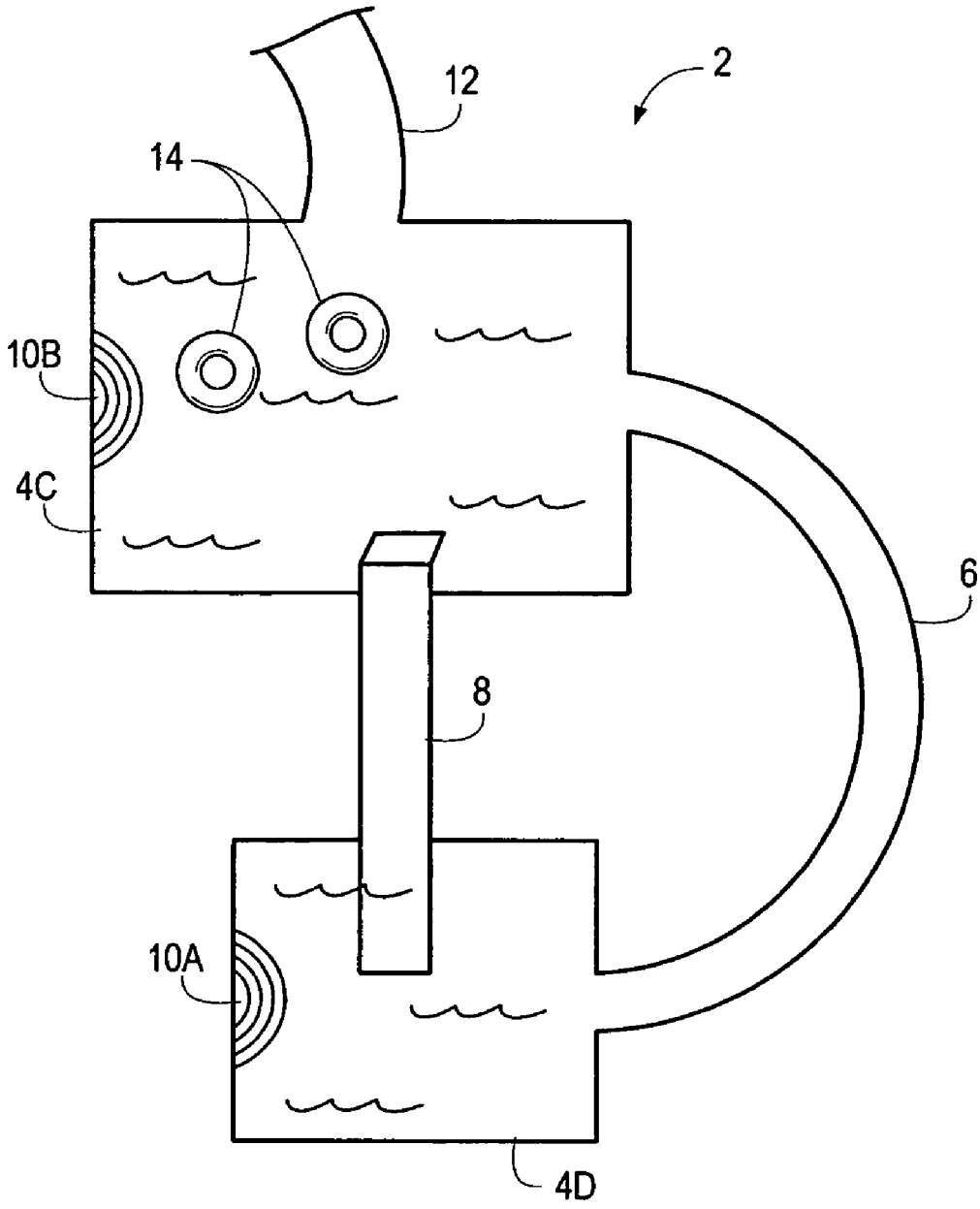
FIG. 2 depicts an embodiment of a portion of a continuous water slide.

FIG. 2 depicts an embodiment of a portion of continuous water ride 2. Continuous water ride 2 may include body of water 4C. Body of water 4C may be coupled to downhill water slide 6. Downhill water slide 6 may couple body of water 4C to body of water 4D. Body of water 4D may be positioned at a lower elevation than body of water 4C. Body of water 4D may include access point 10A. Access point 10A may allow participants to safely enter and/or exit body of water 4D. As depicted in FIG. 2 access points 10 may be stairs. Access points 10 may also include ladders and/or a gradually sloping walkway. Body of water 4D may be coupled to body of water 4C with elevation system 8. Elevation system 8 as depicted in FIG. 2 is a conveyor belt system. Elevation system 8 may be at least any system of elevation described herein. Body of water 4C may be coupled to a second water ride. The second water ride may be, for example, lazy river 12.

FIG. 2 depicts one small example of continuous water ride 2. Continuous water ride 2 may allow participants and/or their vehicles 14 (e.g., inner tubes) to ride continually without having to leave their vehicle. For example a participant may enter body of water 4C through access point 10B. The participant may ride vehicle 14 down downhill water slide 6 to body of water 4D. At this point the participant has the choice to exit body of water 4D at access point 10A or to ride their vehicle 14 up elevation system 8 to body of water 4C. For safety reasons one or both ends of elevation system 8 may extend below the surface of bodies of water 4. Extending the ends of elevation system 8 below the surface of the water may allow participants to float up on elevation system 8 more safely. Participants who choose to ride elevation system 8 to body of water 4C may then choose to either exit access point 10B, ride downhill water slide 6 again, or ride lazy river 12.

In some embodiments, bodies of water 4 may include multiple elevation systems 8 and multiple water rides connecting each other. In some embodiments, floating queue lines and/or channels may couple water rides and elevation systems. Floating queue lines may help control the flow of participants more efficiently than without using floating queue lines.

Figure 3:
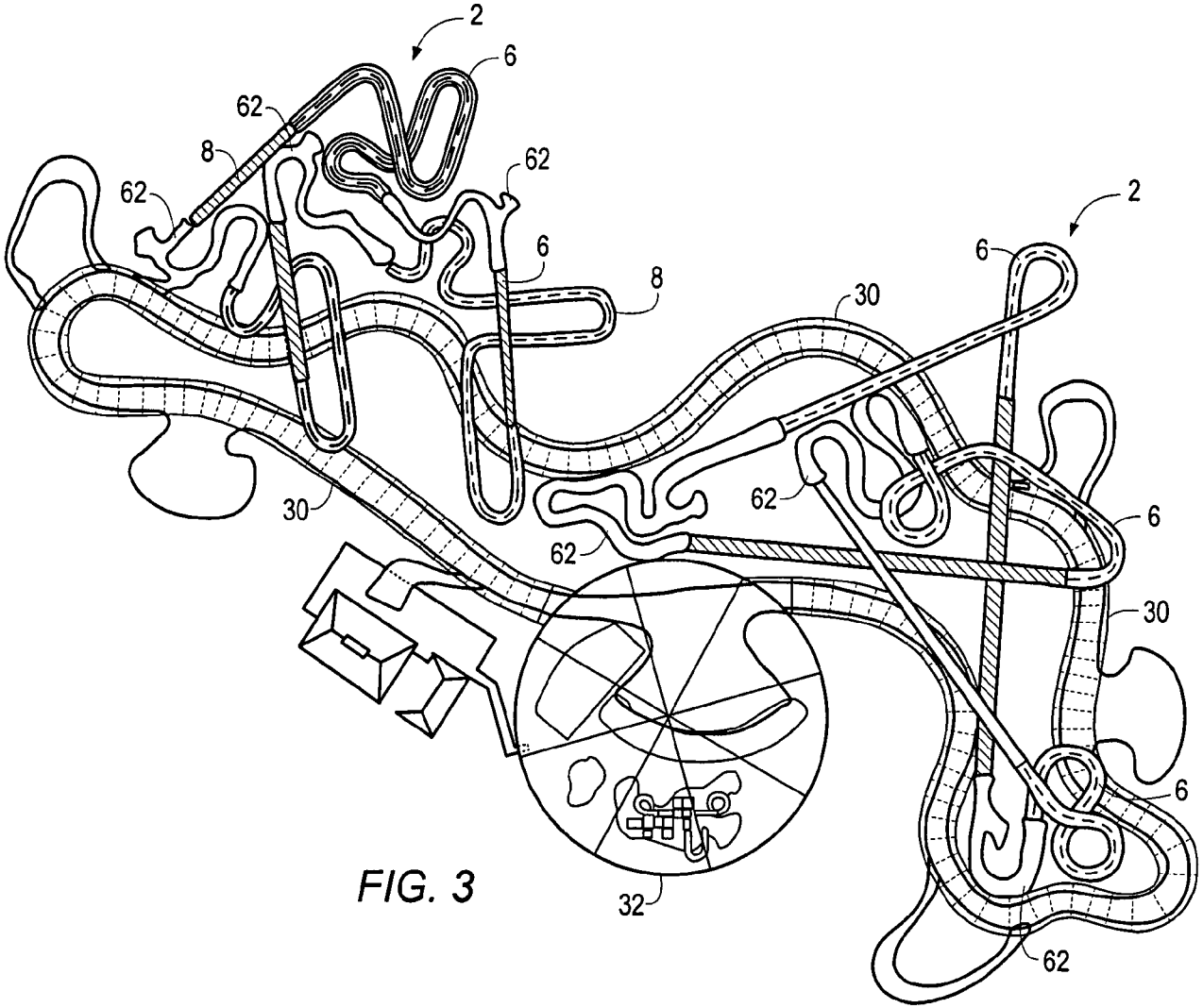
FIG. 3 depicts an embodiment of a water amusement park.

FIG. 3 depicts an embodiment of a water amusement park. Water amusement park 16 depicted in FIG. 3 shows several different examples of continuous water rides 2. Continuous water rides 2 may include elevation systems 8, downhill water slide 6, and floating queue systems 62. Elevation systems 8 may include, for example, conveyor belt systems as depicted in FIG. 3. Downhill water slides 6 may couple elevation systems 8 to floating queue systems 62.

In some embodiments, elevation systems may include a conveyor belt system. Conveyor belt systems may be more fully described in U.S. patent application Ser. No. 09/952,036 (Publication No. US-2002-0082097-A1), herein incorporated by reference. This system may include a conveyor belt system positioned to allow riders to naturally float up or swim up onto the conveyor and be carried up and deposited at a higher level.

The conveyor belt system may also be used to take riders and vehicles out of the water flow at stations requiring entry and/or exit from the continuous water ride. Riders and vehicles float to and are carried up on a moving conveyor on which riders may exit the vehicles. New riders may enter the vehicles and be transported into the continuous water ride at a desired location and velocity. The conveyor may extend below the surface of the water so as to more easily allow riders to naturally float or swim up onto the conveyor. Extending the conveyor below the surface of the water may allow for a smoother entry into the water when exiting the conveyor belt. Typically the conveyor belt takes riders and vehicles from a lower elevation to a higher elevation, however it may be important to first transport the riders to an elevation higher than the elevation of their final destination. Upon reaching this apex the riders then may be transported down to the elevation of their final destination on a water slide, rollers, or on a continuation of the original conveyor that transported them to the apex. This serves the purpose of using gravity to push the rider off and away from the belt, slide, or rollers into a second water ride of the continuous water ride and/or a floating queue. The endpoint of a conveyor may be near a first end of a horizontal hydraulic head channel wherein input water is introduced through a first conduit. This current of flowing may move the riders away from the conveyor endpoint in a quick and orderly fashion so as not to cause increase in rider density at the conveyor endpoint. Further, moving the riders quickly away from the conveyor endpoint may act as a safety feature reducing the risk of riders becoming entangled in any part of the conveyor belt or its mechanisms. A deflector plate may also extend from one or more ends of the conveyor and may extend to the bottom of the channel. When the deflector plate extends at an angle away from the conveyor it may help to guide the riders up onto the conveyor belt as well as inhibit access to the rotating rollers underneath the conveyor. These conveyors may be designed to lift riders from one level to a higher one, or may be designed to lift riders and vehicles out of the water, onto a horizontal moving platform and then return the vehicle with a new rider to the water.

The conveyor belt speed may also be adjusted in accordance with several variables. The belt speed may be adjusted depending on the rider density; for example, the speed may be increased when rider density is high to reduce rider waiting time. The speed of the belt may be varied to match the velocity of the water, reducing changes in velocity experienced by the rider moving from one medium to another (for example from a current of water to a conveyor belt). Decreasing changes in velocity is an important safety consideration due to the fact that extreme changes in velocity may cause a rider to become unbalanced. Conveyor belt speed may be adjusted so riders are discharged at predetermined intervals, which may be important where riders are launched from a conveyor to a water ride that requires safety intervals between the riders.

Several safety concerns should be addressed in connection with the conveyor system. The actual belt of the system should be made of a material and designed to provide good traction to riders and vehicles without proving uncomfortable to the riders touch. The angle at which the conveyor is disposed is an important safety consideration and should be small enough so as not to cause the riders to become unbalanced or to slide in an uncontrolled manner along the conveyor belt. Detection devices or sensors for safety purposes may also be installed at various points along the conveyor belt system. These detection devices may be variously designed to determine if any rider on the conveyor is standing or otherwise violating safety parameters. Gates may also be installed at the top or bottom of a conveyor, arranged mechanically or with sensors wherein the conveyor stops when the rider collides with the gate so there is no danger of the rider being caught in and pulled under the conveyor. Runners may cover the outside edges of the conveyor belt covering the space between the conveyor and the outside wall of the conveyor so that no part of a rider may be caught in this space. All hardware (electrical, mechanical, and otherwise) should be able to withstand exposure to water, sunlight, and various chemicals associated with water treatment (including chlorine or fluorine) as well as common chemicals associated with the riders themselves (such as the various components making up sunscreen or cosmetics).

Various sensors may also be installed along the conveyor belt system to monitor the number of people using the system in addition to their density at various points along the system. Sensors may also monitor the actual conveyor belt system itself for breakdowns or other problems. Problems include, but are not limited to, the conveyor belt not moving when it should be or sections broken or in need of repair in the belt itself. All of this information may be transferred to various central or local control stations where it may be monitored so adjustments may be made to improve efficiency of transportation of the riders. Some or all of these adjustments may be automated and controlled by a programmable logic control system.

Various embodiments of the conveyor lift station include widths allowing only one or several riders side by side to ride on the conveyor according to ride and capacity requirements. The conveyor may also include entry and exit lanes in the incoming and outgoing stream so as to better position riders onto the conveyor belt and into the outgoing stream.

Figure 4:
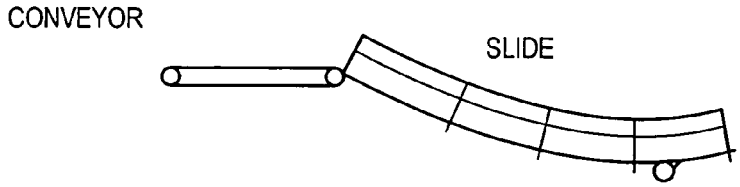
FIG. 4 depicts a side view of an embodiment of a conveyor lift station coupled to a water ride.
Figure 5:
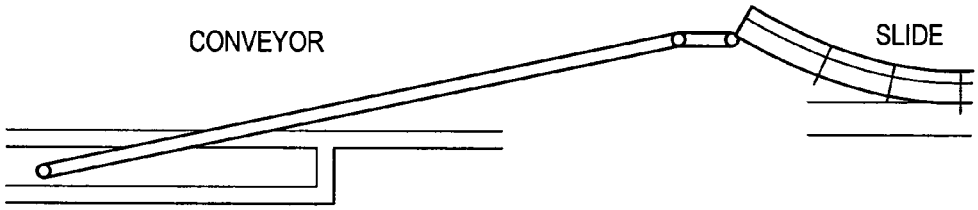
FIG. 5 depicts a side view of an embodiment of a conveyor lift station with an entry conveyor coupled to a water slide.
Figure 6:
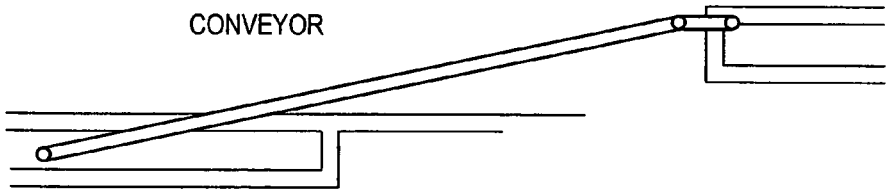
FIG. 6 depicts a side view of an embodiment of a conveyor lift station coupled to an upper channel.

More embodiments of conveyor systems are shown in FIGS. 4-6. FIG. 4 shows a dry conveyor for transporting riders entering the system into a channel. It includes a conveyor belt portion ending at the top of downhill slide 6 which riders slide down on into the water. FIG. 5 shows a wet conveyor for transporting riders from a lower channel to a higher one with downhill slide 6 substituted for the launch conveyor. FIG. 6 shows a river conveyor for transporting riders from a channel to a lazy river. This embodiment does not have a descending portion.

In some embodiments, an elevation system may include a water lock system. These systems may be used to increase elevation and/or decrease elevation. In certain embodiments, an exit point of a first water ride of a continuous water ride may have an elevation below an entry point of a second water ride of the continuous water ride. In some embodiments, the water lock system includes a chamber for holding water coupled to the exit point of the first water ride and the entry point of the second water ride. A chamber is herein defined as an at least partially enclosed space. The chamber includes at least one outer wall, or a series of outer walls that together define the outer perimeter of the chamber. The chamber may also be at least partially defined by natural features such as the side of a hill or mountain. The walls may be substantially watertight. The outer wall of the chamber, in certain embodiments, extends below an upper surface of the first water ride and above the upper surface of the second water ride. The chamber may have a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

A first movable member may be formed in the outer wall of the chamber. The first movable member may be positioned to allow participants and water to move between the exit point of the first water ride and the chamber when the first movable member is open during use. A second movable member may be formed in the wall of the chamber. The second movable member may be positioned to allow participants and water to move between the entry point of the second water ride and the chamber when the second movable member is open during use. The second movable member may be formed in the wall at an elevation that differs from that of the first movable member.

In certain embodiments, the first and second movable members may be configured to swing away from the chamber wall when moving from a closed position to an open position during use. In certain embodiments, the first and second movable members may be configured to move vertically into a portion of the wall when moving from a closed position to an open position. In certain embodiments, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In certain embodiments, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber. There may be one or more bottom members positioned within a single chamber. The bottom member may incorporate water jets to direct and/or propel participants in or out of the chamber.

The lock system may also include a substantially vertical first ladder coupled to the wall of the bottom member and a substantially vertical second ladder coupled to a wall of the chamber. The first and second ladders, in certain embodiments, are positioned such that the ladders remain substantially aligned as the bottom member moves vertically within the chamber. The second ladder may extend to the top of the outer wall of the chamber. The ladders may allow participants to exit from the chamber if the lock system is not working properly.

In certain embodiments, water may be transferred into and out of the water lock system via the movable members formed within the chamber wall. Opening of the movable members may allow water to flow into the chamber from the second water ride or out of the chamber into the first water ride.

The lock system may also include a controller for operating the system. The automatic controller may be a computer, programmable logic controller, or any other control device. The controller may be coupled to the first movable member, the second movable member, and the first water control system. The controller may allow manual, semi-automatic, or automatic control of the lock system. The automatic controller may be connected to sensors positioned to detect if people are in the lock or not, blocking the gate, or if the gate is fully opened or fully closed or the water levels within the chambers.

In certain embodiments, the participants may be floating in water during the entire transfer from the first water ride to the second water ride. The participants may be swimming in the water or floating upon a floatation device. Preferably, the participants are floating on an inner tube, a floatation board, raft, or other floatation devices used by riders on water rides.

In certain embodiments, the lock system may include multiple movable members formed within the outer wall of the chamber. These movable members may lead to multiple water rides and/or continuous water ride systems coupled to the chamber. The additional movable members may be formed at the same elevational level or at different elevations.

In some embodiments, a first and second movable members formed in the outer wall of a chamber of a lock system may be configured to move vertically into a portion of the wall when moving from a closed position to an open position. The members may be substantially hollow, and have holes in the bottom configured to allow fluid flow in and out of the member. In an open position, the hollow member may be substantially filled with water. To move the member to a closed position, compressed air from a compressed air source may be introduced into the top of the hollow member through a valve, forcing water out of the holes in the bottom of the member. As the water is forced out and air enters the member, the buoyancy of the member may increase and the member may float up until it reaches a closed position. In this closed position, the holes in the bottom of the member may remain submerged, thereby preventing the air from escaping through the holes. To move the member back to an open position, a valve in the top of the member may be opened, allowing the compressed air to escape and allowing water to enter through the holes in the bottom. As water enters and compressed air escapes, the gate may lose buoyancy and sink until it reaches the open position, when the air valve may be closed again.

An advantage to the pneumatic gate system may be that water may be easily transferred from a higher lock to a lower one over the top of the gate. This system greatly simplifies and reduces the cost of valves and pumping systems between lock levels. The water that progressively spills over the top of the gate as it is lowered is at low, near-surface pressures in contrast to water pouring forth at various pressures in a swinging gate lock system. This advantage makes it feasible to eliminate some of the valves and piping required to move water from a higher lock to a lower lock.

In certain embodiments a pneumatic or hydraulic cylinder may be used to vertically move a gate system. An advantage to this system may be that the operator has much more control over the gate than with a gate system operating on a principle of increasing and decreasing the buoyancy. More control of the gate system may allow the gates to be operated in concert with one another, as well as increasing the safety associated with the system. The gate may be essentially hollow and filled with air or other floatation material such as Styrofoam, decreasing the power needed to move the gate.

While described as having only a single chamber coupled to two water rides forming a continuous water ride, it should be understood that multiple chambers may be interlocked to couple two or more water rides of a first continuous water ride and/or a second continuous water ride. By using multiple chambers, a series of smaller chambers may be built rather than a single large chamber. In some situations it may be easier to build a series of chambers rather than a single chamber. For example, use of a series of smaller chambers may better match the slope of an existing hill. Another example is to reduce water depths and pressures operating in each chamber so as to improve safety and reduce structural considerations resulting from increased water pressure differentials. Another example is the use of multiple chambers to increase aesthetics or ride excitement. Another is the use of multiple chambers to increase overall speed and rider throughput of the lock.

The participants may be transferred from the first water ride to the second water ride by entering the chamber and altering the level of water within the chamber. The first movable member, coupled to the first water ride is opened to allow the participants to move into the chamber. The participants may propel themselves by pulling themselves along by use of rope or other accessible handles or be pushed directly with waterjets or be propelled by a current moving from the lower water ride toward the chamber. The current may be generated using waterjets positioned along the inner surface of the chamber. Alternatively, a current may be generated by altering the level of water in the first water ride. For example, by raising the level of water in the first water ride a flow of water from the first water ride into the chamber may occur.

After the participants have entered the chamber, the first movable member is closed and the level of water in the chamber is altered. The level may be raised or lowered, depending on the elevation level of the second water ride with respect to the first water ride. If the second water ride is higher than the first water ride, the water level is raised. If the first water ride is at a higher elevation than the second water ride, the water level is lowered. As the water level in the chamber is altered, the participants are moved to a level commensurate with the upper surface of the second water ride. While the water level is altered within the chamber, the participants remain floating proximate the surface of the water. A bottom member preferably moves with the upper surface of the water in the chamber to maintain a relatively constant and safe depth of water beneath the riders. The water level in the chamber, in certain embodiments, is altered until the water level in the chamber is substantially equal to the water level of the second water ride. The second movable member may now be opened, allowing the participants to move from the chamber to the second water ride. In certain embodiments, a current may be generated by filling the chamber with additional water after the level of water in the chamber is substantially equal to the level of water outside the chamber. As the water is pumped in the chamber, the resulting increase in water volume within the chamber may cause a current to be formed flowing from the chamber to the water ride. When the movable member is open, the formed current may be used to propel the participants from the chamber to a water ride. Thus, the participants may be transferred from a first water ride to a second water ride without having to leave the water forming a continuous water ride. The participants are thus relieved of having to walk up a hill. The participants may also be relieved from carrying any floatation devices necessary for the continuous water ride.

Figure 7:
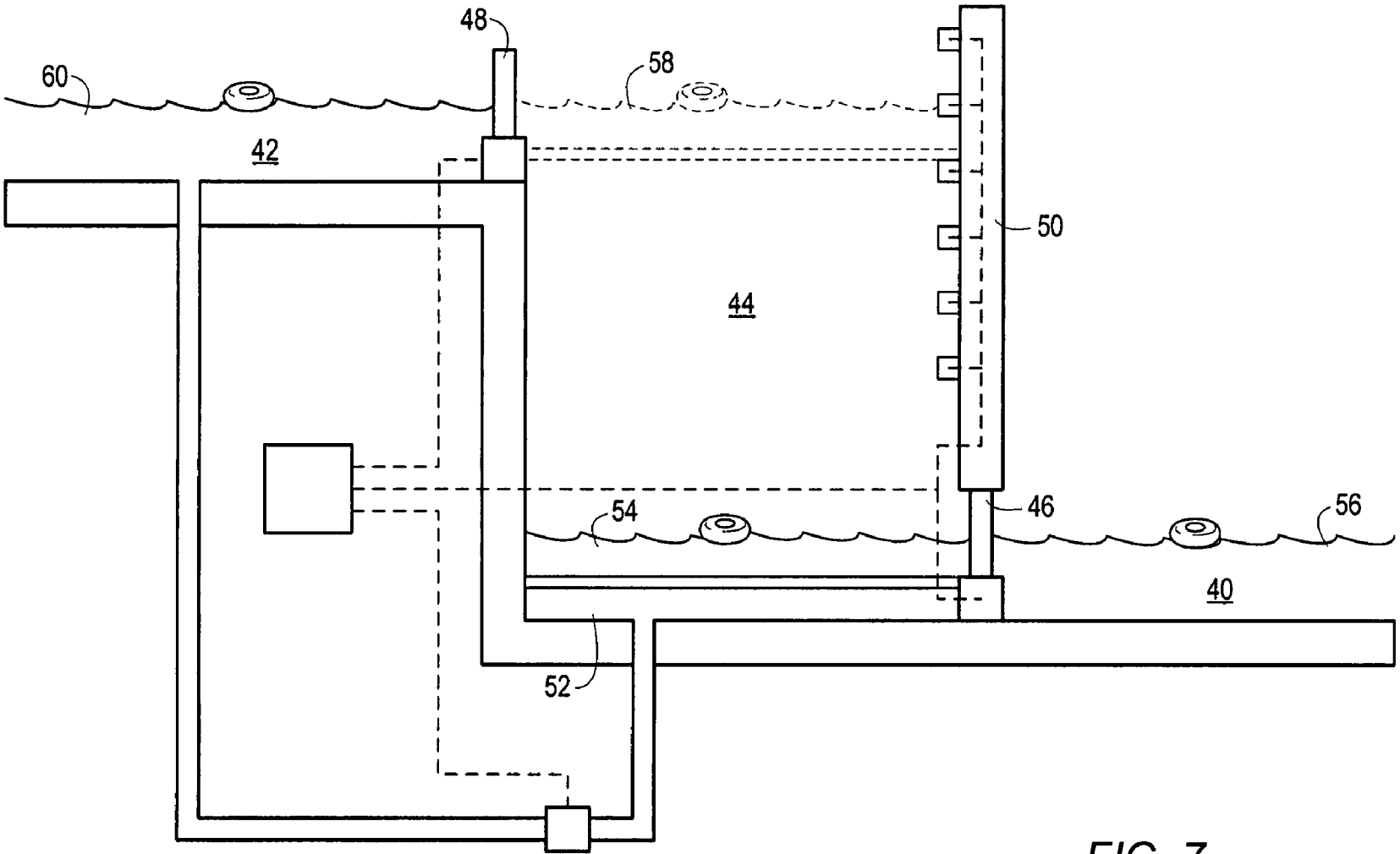
FIG. 7 depicts a cross-sectional side view of an embodiment of a water lock system with one chamber and a conduit coupling the upper body of water to the chamber.

FIG. 7 depicts a water lock system for conveying a person or a group of people (i.e., the participants) from a lower body of water 40 to an upper body of water 42. It should be understood that while a system and method of transferring the participants from the lower body of water to the upper body of water is herein described, the lock system may also be used to transfer participants from an upper body to a lower body, by reversing the operation of the lock system. The upper and lower bodies of water may be receiving pools (i.e., pools positioned at the end of a water ride), entry pools (i.e., pools positioned to at the entrance of a water ride), another chamber of a water lock system, or a natural body of water (e.g., a lake, river, reservoir, pond, etc.). The water lock system, in certain embodiments, includes at least one chamber 44 coupled to the upper and lower bodies of water. First movable member 46 and second movable member 48 may be formed in an outer wall 50 of the chamber. First movable member 46 may be coupled to lower body of water 40 such that the participants may enter chamber 44 from the lower body of water while the water 52 in the chamber is at level 54 substantially equal to upper surface 56 of the lower body of water. After the participants have entered chamber 44, the level of water within the chamber may be raised to a height 58 substantially equal to upper surface 60 of upper body of water 42. Second movable member 48 may be coupled to upper body of water 42 such that the participants may move from chamber 44 to the upper body of water after the level of water in the chamber is raised to the appropriate height.

Outer wall 50 of chamber 44 may be coupled to both lower body of water 40 and upper body of water 42. Outer wall 50 may extend from a point below upper surface 56 of lower body of water 40 to a point above upper surface 60 of upper body of water 42. Water lock systems may be more fully described in U.S. patent application Ser. No. 09/952,036.

In some embodiments, elevation systems may not be mere systems of conveyance to different elevation levels. Elevations systems may be designed to be entertaining and an enjoyable part of the water ride as well as the water rides of the continuous water ride which the elevation system is connecting. For example, when the elevation system includes an uphill water slide, the entertainment value may be no less for the elevation system of the continuous water ride than for the connected water rides.

In some embodiments, elevation systems may be part of the entertainment experience (e.g., uphill water slides). In certain embodiments, an elevation system may include a "ferris lock." The ferris lock being so named due to its similarity to a combination between a Ferris wheel and a water lock system as described herein. The ferris lock may include a chamber for holding water. The chamber may be configurable to hold one or more vehicles. The vehicles may be flexible. The vehicles may be inflatable (e.g., inner tubes). A rotational member may be coupled to the chamber. The rotational member may rotate the chamber between different elevation levels. There may be two or more elevation levels.

In some embodiments, different elevation levels of a ferris lock may include an entry point to a portion of a water amusement park (e.g., a water amusement ride). Different elevational levels of a ferris lock may include an entry and an exit point of two different portions of a water amusement park on the same elevation level. A chamber of a ferris lock may carry one or more vehicles and/or participants from one elevation level to another.

In some embodiments, a ferris lock system may include one or more safety features to prevent injury during use. One example of a safety feature may include retaining members coupled to a chamber of the ferris lock. Retaining members may inhibit vehicles from moving into or out of the chamber while moving between different elevation levels. Walls of the chamber may act naturally as retaining members if they are high enough relative to the water level in the chamber. However if the walls of the chamber are used as retaining members, this does not allow participants to see their surrounding environment very well during the ride. Not allowing participants to see their surrounding environment may reduce the entertainment factor of the ride. To overcome this problem the retaining members may be made of some type of bars, epoxy coated wire mesh, and/or plastic netting. In some embodiments, retaining members may be formed from thick sheets of glass or translucent polymers (e.g., polycarbonate). In one example, substantially all or most of chamber may be formed from translucent or substantially translucent materials. Providing a similar effect as demonstrated in, for example, glass bottomed boats.

In some embodiments, a ferris lock system may include a chamber where water levels within the chamber are kept intentionally low. Optimally water levels may be kept at a point where vehicles within the chamber freely float. As a safety feature water levels may be kept at a level which allows most participants to stand within the chamber and still keep at least their head above water. Keeping the water at such a low level may inhibit accidental drowning. Water levels within the chamber may be maintained any number of ways. Retaining members may be designed to keep vehicles and participants in the chamber while allowing water to drain off to an appropriate level in the chamber. Drain holes may bored into sides of the chambers at an appropriate level to allow excess water to drain out of the chamber during use.

In some embodiments, a chamber of a ferris lock may include a movable member. The movable member may act as a gate between the chamber and each elevation level. The movable member when in a first position may act to inhibit anything contained in the chamber from exiting (e.g., water, vehicles and/or participants). The movable member when in a second position may allow participants and/or vehicles to exit the chamber. Movable members may operate in a similar fashion to movable members as described in U.S. patent application Ser. No. 09/952,036 as regards water locks. Participants may exit the chamber under their own power. In some embodiments, participants/vehicles may be assisted in exiting a chamber. For example, water jets (depicted in FIG. 8), as described in U.S. patent application Ser. No. 09/952,036 as regards floating queue lines, may be used to direct participants out of the chamber. The water level in the chamber may be higher than the water level at an elevation level stop. The higher water level in the chamber may be due, for example, to the water being deeper in the chamber than in the elevation level stop. The higher water level in the chamber may be due, for example, to the chamber being designed to actually stop at a higher elevation level than the elevation level stop. When the movable member is moved to the second position, allowing participants to exit the chamber, and the water in the chamber is at a higher level, the movement of water from the chamber to the elevation level stop may assist participant/vehicles in moving into the elevation level stop.

In some embodiments, different elevation levels may include similar movable members as described regarding ferris lock chambers. The elevation level movable members may work in combination with chamber movable members to allow participants to exit and enter the ferris lock chamber.

In some embodiments, movable members may not be necessary to allow exit or entry into a chamber of a ferris lock. For example one elevational level may include a body of water. The body of water may be a natural or man made pool or lake. The chamber of the ferris lock may rotate to a position lower than the surface level of the lake. The chamber lowering to a level below the surface of the lake would allow participants to enter or exit the chamber safely. In some embodiments, all of the chamber except the retaining member may be below water. At least one of the retaining members may be positionable so as to allow access to the chamber. Once in the chamber, a participant and/or operator may reposition the retaining member so as to inhibit the participant from exiting the chamber while it is moving.

Figure 9:
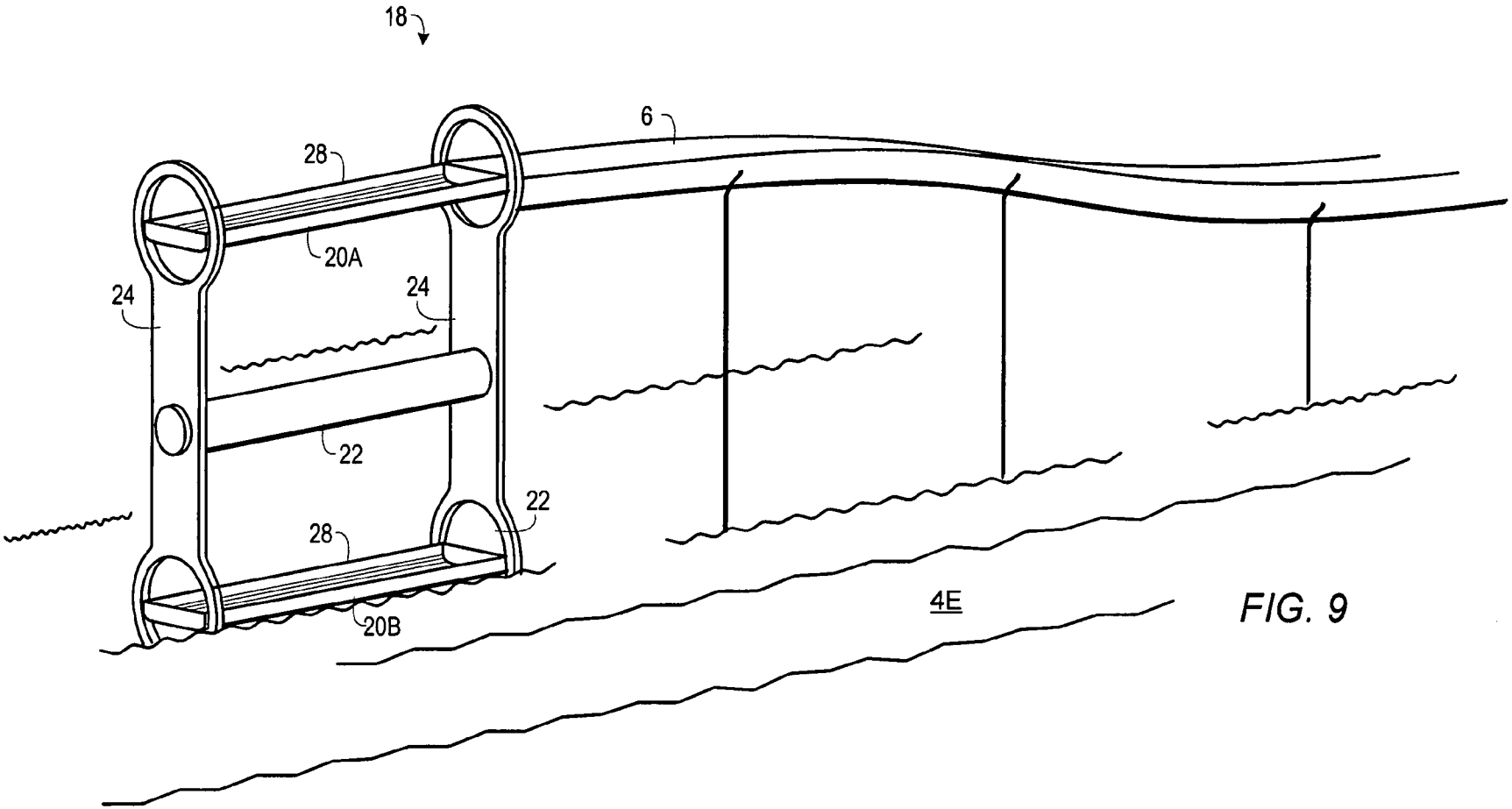
FIG. 9 depicts an embodiment of a ferris lock with two chambers.

FIG. 9 depicts an embodiment of ferris lock 18. Ferris lock 18 may include chambers 20A-B and rotational member 22. Chambers 20A-B may be coupled to rotational member 22. Chambers 20A-B may be coupled to rotational member 22 using supports 24. Rotational member 22 may be coupled to a power source and/or engine (not shown). Rotational member 22 may rotate. Rotation of rotational member 22 may rotate supports 24 and chambers 20A-B. Chambers 20A-B may contain water during use. Water contained within chambers 20A-B may be of a level low enough to allow most participants to stand and keep at least their head above water, while still allowing participant vehicles contained within chambers 20A-B to float. For example, water in chambers 20A-B may be no more than about 3 feet deep and no less than about 1 foot deep. In some embodiments, water in chambers 20A-B may be no more than about 4 feet deep and no less than about 2 foot deep. Rotation of chambers 20A-B may transport vehicles and/or participants from body of water 4E to an entry point of downhill water slide 6. Supports 24 may include openings 26. Ends of chambers 20A-B may sit within openings 26. Ends of chambers 20A-B may sit within tracks in openings 26. Tracks within openings 26 may allow chambers 20A-B to rotate freely within openings 26. Freely rotating chambers 20A-B may allow chambers 20A-B to remain upright safely transporting participants between different elevational heights. Appropriate measures may be taken to ensure chambers 20A-B remain upright, for example, adding weight to the bottom of chambers 20A-B to inhibit chambers 20A-B from flipping over. Chambers 20A-B may include retaining members 28. Retaining members 28 may inhibit participants and/or vehicles from exiting chambers 20A-B while they are moving. Chambers 20A-B may be designed to hold any number of participants and/or vehicles. Ferris lock 18 is depicted in FIG. 9 with only two chambers 20, however, ferris lock 18 may be designed with three or more chambers 20 coupled to rotational member 22.

Figure 10:
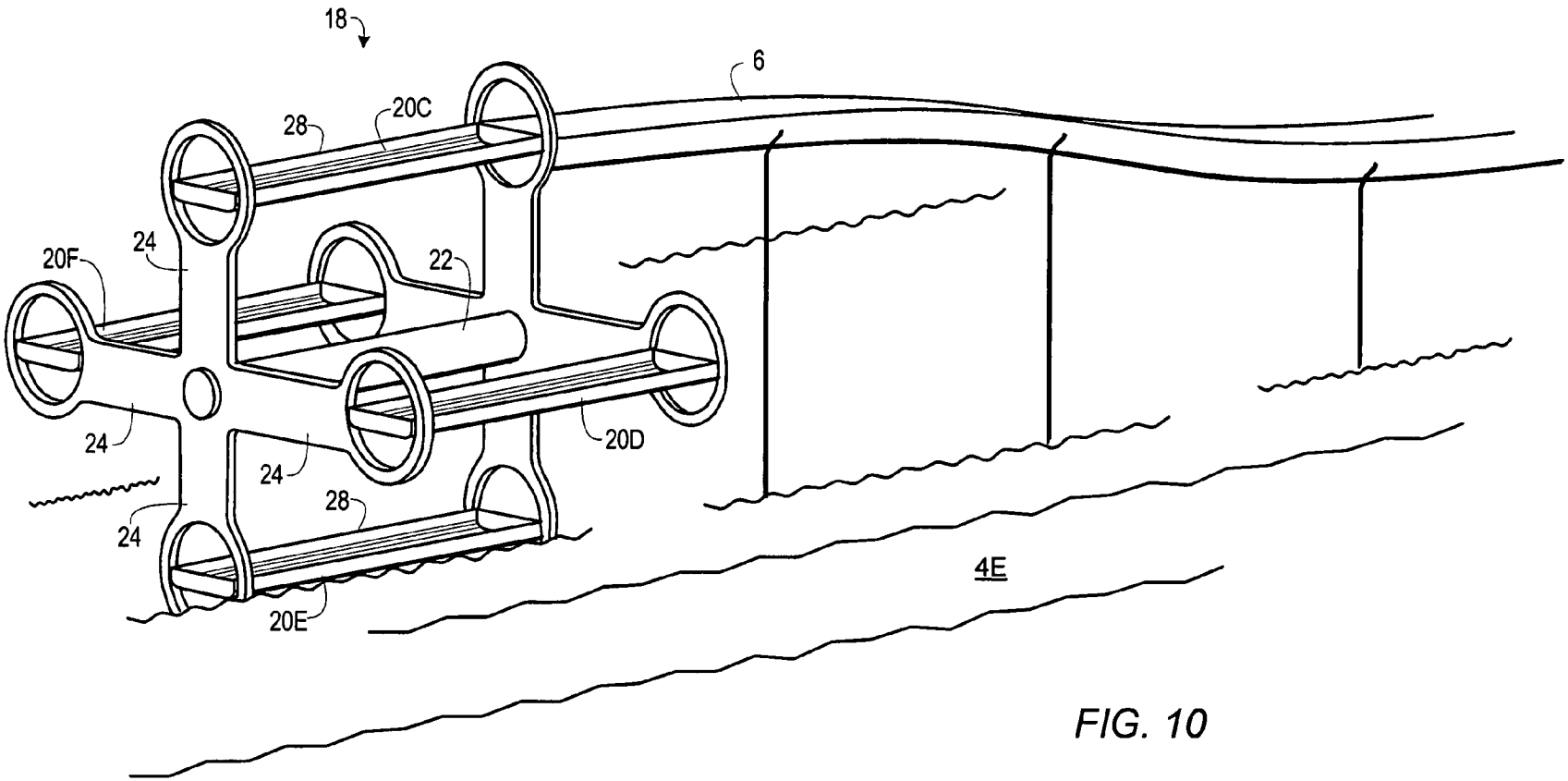
FIG. 10 depicts an embodiment of a ferris lock with two chambers.

FIG. 10 depicts an embodiment of a ferris lock. Ferris lock 18 may function similarly to ferris lock 18 depicted in FIG. 9. Ferris lock 18 may include chambers 20C-F and rotational member 22. Chambers 20C-E may be coupled to rotational member 22. Chambers 20C-F may be coupled to rotational member 22 using supports 24. Ferris lock 18 depicted in FIG. 10 may include four chambers 20C-F coupled to rotational member 22.

In some embodiments, an exit point of a second water ride of a continuous water ride may be coupled to an entry point of a first water ride. Coupling the exit point of the second water ride to the entry point of the first water ride may form a true continuous water ride loop. The continuous water ride may include a second elevation system coupling the exit point of the second water ride to the entry point of the first water ride. The second elevation system may include any of the elevation systems described for use in coupling an exit point of the first water ride to the entry point of the second water ride. The second elevation system may be a different elevation system than the first elevation system. For example, the first elevation system may be an uphill water slide and the second water elevation system may be a conveyor belt system.

In some embodiments, a continuous water ride may include one or more floating queue lines. Floating queue lines may be more fully described in U.S. Patent Publication No. 20020082097. Floating queue lines may assist in coupling different portions of a continuous water ride. Floating queue line systems may be used for positioning riders in an orderly fashion and delivering them to the start of a ride at a desired time. In certain embodiments, this system may include a channel (horizontal or otherwise) coupled to a ride on one end and an elevation system on the other end. It should be noted, however, that any of the previously described elevation systems may be coupled to the water ride by the floating queue line system. Alternatively, a floating queue line system may be used to control the flow of participants into the continuous water ride from a dry position within a station.

In use, riders desiring to participate on a water ride may leave the body of water and enter the floating queue line. The floating queue line may include pump inlets and outlets similar to those in a horizontal channel but configured to operate intermittently to propel riders along the queue line, or the inlet and outlet may be used solely to keep a desired amount of water in the queue line. In the latter case, the channel may be configured with high velocity low volume jets that operate intermittently to deliver participants to the end of the queue line at the desired time.

In certain embodiments, the water moves participants along the floating queue line down a hydraulic gradient or bottom slope gradient. The hydraulic gradient may be produced by out-flowing the water over a weir at one end of the queue after the rider enters the ride to which the queue line delivers them, or by out-flowing the water down a bottom slope that starts after the point that the rider enters the ride. In certain embodiments, the water moves through the queue channel by means of a sloping floor. The water from the outflow of the queue line in any method can reenter the main channel, another ride or water feature/s, or return to the system sump. Preferably the water level and width of the queue line are minimized for water depth safety, rider control and water velocity. These factors combined deliver the participants to the ride in an orderly and safe fashion, at the preferred speed, with minimal water volume usage. The preferred water depth, channel width and velocity would be set by adjustable parameters depending on the type of riding vehicle, participant comfort and safety, and water usage. Decreased water depth may also be influenced by local ordinances that determine level of operator or lifeguard assistance, the preferred being a need for minimal operator assistance consistent with safety.

In some embodiments, continuous water rides may include exits or entry points at different portion of the continuous water ride. Floating queue lines coupling different portions and/or rides forming a continuous water ride may include exit and/or entry points onto the continuous water ride. Exit/entry points may be used for emergency purposes in case of, for example, an unscheduled shutdown of the continuous water ride. Exit/entry points may allow participants to enter/exit the continuous water ride at various designated points along the ride during normal use of the continuous water ride. Participants entering/exiting the continuous water ride during normal use of the ride may not disrupt the normal flow of the ride depending on where the entry/exit points are situated along the course of the ride.

Embodiments disclosed herein provide an interactive control system for a continuous water ride and/or portions of the continuous water ride. In certain embodiments, the control system may include a programmable logic controller. The control system may be coupled to one or more activation points, participant detectors, and/or flow control devices. In addition, one or more other sensors may be coupled to the control system. The control system may be utilized to provide a wide variety of interactive and/or automated water features. In some embodiments, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, a participant identifier and/or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to produce one or more control systems to active a water system, sound system, and/or light system in response to a detection signal indicating that a participant is proximate to an activation point. The control system may also be coupled to flow control devices, such as, but not limited to: valves, and pumps. Valves may includes air valves and water valves configured to control the flow air or water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more activation signals in the absence of an activation signal. For example, if no activation signal is received for a predetermined amount of time, the control system may produce one or more control signals to activate a water system, sound system, and/or light system.

Throughout the system electronic signs or monitors may be positioned to notify riders or operators of various aspect of the system including, but not limited to: operational status of any part of the system described herein above; estimated waiting time for a particular ride; and possible detours around non operational rides or areas of high rider density.

In some embodiments, a water amusement park may include a cover or a screen. Screens may be used to substantially envelope or cover a portion of a water amusement park. Portions of the screen may be positionable. Positionable screen portions may allow portions of the park to be covered or uncovered. The decision to cover or uncover a portion of the water amusement park may be based on the weather. Inclement weather may prompt operators to cover portions of the water park with the positionable screens. While clear warm weather may allow operators to move the positionable screen so portions of the water amusement park remain uncovered.

In some embodiments, positionable screens may be formed from substantially translucent materials. Translucent materials may allow a portion of the visible light spectrum to pass through the positionable screens. Translucent materials may inhibit transmittance of certain potentially harmful portions of the light spectrum (e.g., ultraviolet light). Filtering out a potentially harmful portion of the light spectrum may provide added health benefits to the water amusement park relative to uncovered water amusement parks. A non-limiting example of possible screen material may include Foiltech. Foiltech has an R protective value of about 2.5. A non-limiting example of possible screen material may include polycarbonates. Polycarbonates may have an R protective value of about 2. In some embodiments, multiple layers of screen material (e.g., polycarbonate) may be used. Using multiple layers of screen material may increase a screen materials natural thermal insulating abilities among other things. Portions of the screening system described herein may be purchased commercially at Arqualand in the United Kingdom.

In some embodiments, portions of the positionable screen may assist in collecting solar radiation. Solar radiation collected by portions of the positionable screen may be used to increase the ambient temperature in the area enclosed by the screen. Increasing the ambient temperature in enclosed portions of the water amusement park using collected solar radiation may allow the water amusement park to remain open to the public even when the outside temperature is uncomfortably cold and unconducive to typical outside activities.

In some embodiments, positionable screens may be used to enclose portions of a water amusement park. Enclosed areas of the water amusement park may function as a heat sink. Heat emanating from bodies of water within the enclosed area of the water amusement park may be captured within the area between the body of water and the positionable screens. Heat captured under the positionable screens may be recirculated back into the water. Captured heat may be recirculated back into the water using heat pumps and/or other common methods known to one skilled in the art.

In some embodiments, screens may be mounted on wheels and/or rollers. Screen may be formed from relatively light but strong materials. For example panels may be formed from polycarbonate for other reasons described herein, while structural frameworks supporting these panels may be formed from, for example, aluminum. Lightweight, well-balanced, support structures on wheels/rollers might allow screens to be moved manually by only a few operators. Operators might simply push screens into position. Mechanisms may installed to assist operators in manually positioning screens (e.g., tracks, pulley mechanisms).

Examples of systems which facilitate movement of screens over bodies of water and/or channels (e.g., track based systems) are illustrated in U.S. Pat. No. 4,683,686 to Ozdemir and U.S. Pat. No. 5,950,253 to Last, each of which is incorporated by reference as if fully set forth herein.

In some positionable screen embodiments, screens may be moved using automated means. Powered engines (e.g., electrically driven) may be used to move positionable screens around using central control systems. Control systems may be automated to respond to input from sensors designed to track local weather conditions. For example, sensors may detect when it is raining and/or the temperature. When it begins to rain and/or the temperature drop below a preset limit an automated control system may move positionable screen to enclose previously unenclosed portions of the water amusement park.

Figure 11:
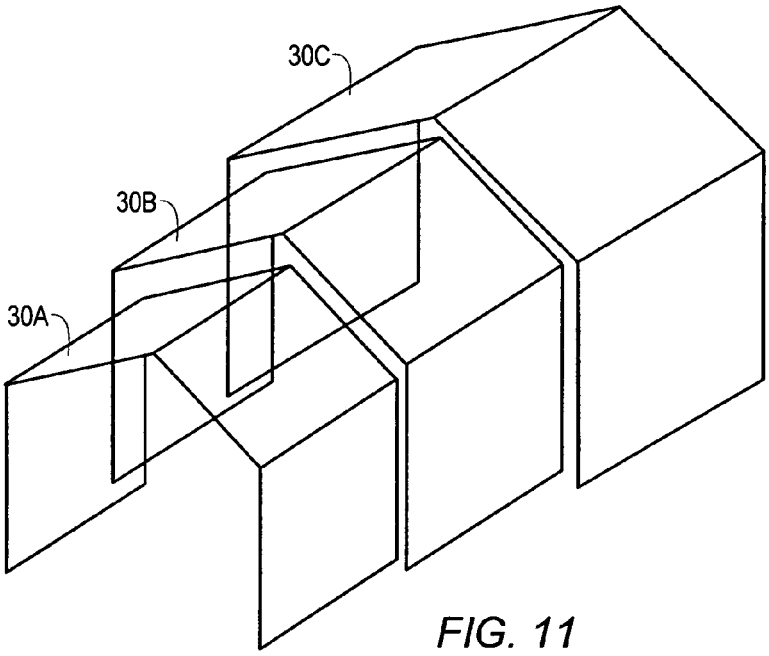
FIG. 11 depicts an embodiment of a positionable screen for a convertible water park.

In some embodiments, screens may be mounted to a fixed skeletal structure. The fixed skeletal structure may not move. The screens mounted to the fixed skeletal structure may be positionable along portions of the fixed skeletal structure. For example portions of a screen may be mounted on tracks positioned in the fixed skeletal structure. Tracks may allow the portions of the screens to be move up, down, and/or laterally. Positionable portions of screens mounted in a fixed skeletal structure may provide an alternative for opening/enclosing a portion of a waterpark to positionable screens as depicted in FIG. 11. In certain embodiments, the two concepts may be combined whereby portions of, for example, screen 30A are positionable within a skeletal structure of screen 30A.

Figure 12:
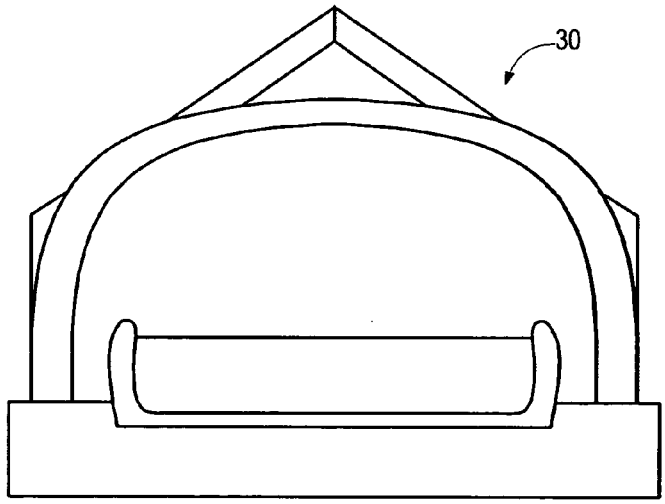
FIG. 12 depicts an embodiment of a positionable screen for a convertible water park.

FIG. 11 depicts an embodiment of a portion of a positionable screen system for use in a water amusement park. Screens 30A-C may be successively smaller. Making screens 30A-C successively smaller may allow the screens to be retracted within one another in a "stacked" configuration when not in use. During use (e.g., during inclement weather) screens 30A-C may be pulled out from under one another extending the screens over a portion of a waterpark (e.g., a river or channel) to protect participants from the elements. FIG. 12 depicts a cross-sectional view of an embodiment of a portion of a positionable screen system over a body of water. Screens 30A-C may include stops to ensure that when the screens are extended there is always a small overlap between the screens. Screens 30A-C may include seals to close the gaps between the screens when the screens are extended. In this way the portion of the waterpark is substantially enclosed within screens 30A-C. Screens 30A-C may be at least high enough to inhibit participants from colliding with the ceiling of the screens.

In a water amusement park embodiment depicted in FIG. 12, screens 30 have been extended over a portion of a channel or river. The channel connects different portions of a convertible water amusement park. In some embodiments, a channel (e.g., a river) including positionable screens may connect separate water amusement parks. Connecting separate water parks with screened channels may allow a participant to travel between waterparks without leaving the water even during inclement weather. Screens 30 allow for the use of the convertible water amusement park during inclement weather. Screens 30 may allow participants to travel between enclosed water park amusement area 32 and continuous water rides 2 as depicted in FIG. 3. Water park amusement area 32 may include food areas, games, water amusement games, water rides and/or any other popular forms of entertainment.

In some embodiments, screens form a convertible cover, i.e. in which panels forming the cover can slide relative to one another. Some sections, adapted for such structures, may include side grooves. Side grooves may facilitate positioning of the panels allowing the panels to slide relative to each other. In some embodiments, the convertible covers or screens may include curved arches forming the overall structure.

In some embodiments, sections of the framework forming a convertible cover or positionable screen may include frameworks known to one skilled in the art as relates to covers for swimming pools and/or greenhouses. For example, the framework may include substantially tubular metal frames. Portions of the tubular metal frames may include interior reinforcement members. Interior reinforcement members may strengthen the tubular metal frames. Interior reinforcement members may include hollow rectangular section positioned in the tubular metal frames.

In some embodiments, sections of the framework forming the positionable screens may be formed in the overall shape of an arch. Section may include one or more tracks positioned on on or more sides of the framework. The tracks may allow panels (i.e., portions of a screen) to slide along the sections of the framework relative to one another.

In some embodiments, screens may have several rigid frame members. The number may depend upon the length of the area being covered. Each frame member may include a plurality of sections which are connected together in end-to-end relationship. Sections may be any shape (e.g., rectangular, square, triangular). The connection between frame member sections may be by means known to one skilled in the art (e.g., bolts, hinges). Hinges may allow at least a portion of the structure to be folded if it is desired to remove the screen completely area. Each of the rigid frame members may include a pair of oppositely disposed substantially vertical wall sections and ceiling sections jointed together in an arch. Between the rigid frame members are panels of flexible material which may be a canvas or other easily foldable material. End panels may also be formed of a foldable material which is preferably transparent or translucent.

In certain embodiments, a ceiling section may include a pair of parallel, longitudinally extending, channel-shaped side elements and a pair of channel-shaped end elements. The side flanges of each of the four elements forming the section extend inwardly. The side and end elements may be welded together or they may be held together by means of suitable fasteners to form a rectangular frame section. Attached to the outer (upper) side flanges of the elements are spacers which extend around the periphery of the structure. Outwardly of the spacers and coextensive with the side elements are a pair of upwardly extending smaller channel elements which are of greater width than the spacer and thus protrude inwardly over and are spaced from the top web of the larger side elements. This spacing will accommodate a rigid panel of transparent or translucent material such as plexiglass. Around the panel may be a resilient bead of flexible material which serves as a weather seal for the panel. Bolts may be used to connect the end element of frame section to the opposite end element of the next adjacent frame section. If desired, braces may be bolted to the sides of the frame member sections for added rigidity and strength at the joint.

In some embodiments, extending along the sides of the body of water may be a pair of spaced, parallel, channel-shaped track members. The track members may be identical in construction. The track member may have a base, sides, and top flanges. Top flanges close a part of the channel-shaped track member leaving only the longitudinal slot-like opening visible from the top of the track. The tracks may extend well beyond one end of the body of water so that the screen may be stored at that end. For drainage as well as assembly purposes, it may be desirable that at least one end of the track be open. The track may be suitably anchored by conventional screw anchors or the like (not shown).

In some embodiments, attached to the lower ends of each of the frame member wall portions are guide means which extend into the interior of a respective one of the channel-shaped track members for engaging the interior of the track members. Guide means allow that the frame members may be guided along the track members toward and away from one another to selectively cover and uncover the body of water between the track members.

In certain embodiments, a wall panel of a screen as well as the entire rigid frame structure may be clamped in the desired position of adjustment with respect to the track.

In certain embodiments, there may be a laterally stabilizing roller for engaging the side walls of the channel track. This roller also serves as part of the guide means to guide the frame member along the track keeping it in longitudinal alignment.

In some embodiments, for purposes of stability and smooth rolling action there may be provided a horizontal roller and a vertical roller at each end of the wall panels of the screen. Thus each of the wall panels will have a pair of vertical rollers and a pair of horizontal rollers.

In some embodiments, each of the frame members may have a pair of spaced, parallel, transverse portions. The end elements and the panel maintain the spacing of the side elements and the rigidity of the frame members. The bottom element of the wall sections may flatly engage the top of the track over a substantial longitudinal distance. This provides a solid locked-in-place stability for the frame member and there is little tendency for the frame members to skew or otherwise become misaligned. The provision of the rollers at either end of the wall panel provide stability during movement of the frame member.

In some embodiments, the end element of frame members meet at obtuse angles. A wedge-like spacer may be placed between the end elements of the adjacent sections. The spacer may be tapered in accordance with the angle at which the two sections are to be joined. The spacer may be apertured or slotted to accommodate the bolts 60 which are used to connect the end elements together.

In some embodiments, the roller carriage acts as the clamp for clamping the frame members in position, however it is not essential that this carriage double as a clamp. The roller carriage may be fixed in place and it could carry not only the horizontal roller but also the vertical roller. Other locking means could be provided for clamping the base plate and the end element of the wall section in flat position against the top of the channel track.

In certain embodiments, only short particular sections covering the body of water or channel may be rigid. A series of short rigid sections as described herein may be coupled together by stretches of flexible material. The sections of flexible material may be much longer relative to the supporting short rigid sections. The flexible material may allow the screen to be collapsed at those points at the screens are repositioned and retracted. The flexible material may be translucent much like the panels making up the rigid sections of the screen.

In some embodiments, some water amusement park areas may include immovable screens substantially enclosing the water amusement area (e.g., a dome structure). While other water amusement areas may remain uncovered year round. Channels may connect different water amusement areas. Channels may include portions of a natural river. Channels may include portions of man-made rivers or reservoirs. Channels may include portions of a natural or man-made body of water (e.g., a lake). The portions of the natural or man-made body of water may include artificial or natural barriers to form a portion of the channel in the body of water. Channels may include positionable screens as described herein. In some embodiments, an entire waterpark may include permanent and/or positionable screens covering the waterpark. In some embodiments, only portions of a waterpark may include permanent and/or positionable screens.

There are advantages to covering the channels and/or portions of the park connected by the channels as opposed to covering the entire park in, for example, one large dome. One advantage may be financial, wherein enclosing small portions and/or channels of a park is far easier from an engineering standpoint and subsequently much cheaper than building a large dome. Channels that extend for relatively long distances may be covered far more easily than a large dome structure extending over the same distance which covers the channel and much of the surrounding area. It is also far easier to retract portions of the screens described herein to selectively expose portions of a waterpark than it is to selectively retract portions of a dome.

In some embodiments, a water amusement park may include participant identifiers. A participant identifier may be a device that is coupled to a participant that provides information about the participant to a sensor, a receiver, or a person. As used herein, the term "participant" may include anyone located in the confines of the water amusement park or related areas including, but not limited to, staff and/or patrons. Participant identifiers may be used for a variety of functions in the water amusement park. For example, participant identifiers may be used to locate and/or identify one or more participants inside the confines of the water amusement park. As another example, participant identifiers may work in conjunction with control systems for amusement rides in the water amusement park. Participant identifiers may be considered as one portion of a water amusement park control system in some embodiments. In certain embodiments, participant identifiers may be provided to each individual participant of the water amusement park. In some embodiments, participant identifiers may be provided for each member of staff working at the water amusement park.

In an embodiment, a participant identifier is an electrical device that transmits signals to an appropriate receiving device. For example, a participant identifier may transmit radio frequency or ultrasonic signals. In one embodiment, a participant identifier is part of a global positioning system. A plurality of sensors may be located throughout an area of interest to receive signals from the participant identifiers. Sensors may function as receiver units. In one embodiment, sensors are positioned throughout the water amusement park. Sensors may be positioned, for example, at particular junctions (i.e., coupling points) along, for example, a continuous water ride. Sensors may be placed along, for example, floating queue lines, channels, entry/exit points along water rides, and/or entry/exit points between portions of the water amusement park. Participant identifiers working in combination with sensors may be used to locate and/or identify participants. In certain embodiments, a participant identifier may be a visual indicator that is read by a human eye or by a camera. In some embodiments, a participant identifier may include a bar code.

Participant identifiers may provide varying levels of detail of information. In one embodiment, a participant identifier contains information that allows identification of a specific individual (e.g., John Smith of Sioux Falls, S.D.) or a unique ID code for an individual (e.g., participant XG123). In another embodiment, a participant identifier provides information that some unspecified individual participant is present at the location of the participant identifier, but does not identify a specific individual. In some embodiments, a participant identifier identifies certain attributes of the participant (e.g., the participant is a member of the Blue Team in a competition).

Participant identifiers and their associated sensors may operate on the same frequency (e.g., radio frequency). In some embodiments, identification of individual participant identifiers may be achieved by a pulse timing technique whereby discrete time slots are assigned for pulsing by individual units on a recurring basis. Pulses received from sensors may be transmitted to decoder logic that identifies the locations of the various transmitter units in accordance with the time interval in which pulses are received from various sensors throughout the water amusement park. A status board or other display device may display the location and/or identity of the participant in the water amusement park. Status of a participant may be displayed in a number of ways. Status of a participant may be displayed as some type of icon on a multidimensional map. Status of a participant may be displayed as part of a chart displaying throughput for a portion of the water amusement park.

In some embodiments, programming means may be provided for a participant identifier. Participant identifiers may be substantially identical in construction and electronic adjustment. Participant identifiers may be programmed to predetermined pulse timing slots by the programming means. Any participant may use any participant identifier. The particular pulse timing slot may be identified as corresponding with a particular participant using a programmer. Participant identifiers may be associated with a particular participant by positioning the participant identifier in a receptacle. The receptacle may be coupled to the programmer. Receptacles may function to recharge a power source powering the participant identifier. In some embodiments, a receptacle may not be necessary and the participant identifier may be associated in the water amusement park with a particular participant via wireless communication between the participant identifier and a programmer.

In some embodiments, participant identifiers may be removably coupled to a participant. The participant identifier may be a band that couples around an appendage of a participant. The band may be attached around, for example, an arm and/or leg of a participant. Participant identifiers may include any shape. In some embodiments, identifiers may be worn around the neck of a participant much like a medallion. In other embodiments, an identifier may be substantially attached directly to the skin of a participant using an appropriate adhesive. In still other embodiments, an identifier may be coupled to an article of clothing worn by a participant. The identifier may be coupled to the article of clothing using, for example, a "safety pin", a plastic clip, a spring clip, and/or a magnetic based clip. In some embodiments, identifiers may be essentially "locked" after coupling the identifier to a participant. A lock may inhibit the identifier from being removed from the participant by anyone other than a staff member except under emergency circumstances. Locking the identifier to the participant may inhibit loss of identifiers during normal use of identifiers. In some embodiments, a participant identifier may be designed to detach form a participant under certain conditions. Conditions may include, for example, when abnormal forces are exerted on the participant identifier. Abnormal forces may result from the participant identifier becoming caught on a protrusion, which could potentially endanger the participant.

In some embodiments, a participant identifier may include an enclosure (e.g., a case, housing, or sleeve) to protect sensitive components such as electronic circuitry and/or power sources. The enclosure may protect sensitive portions of the participant identifier from water and/or corrosive chemicals typically associated with a water amusement park. Participant identifiers may be formed from any appropriate material. Appropriate materials may include materials that are resistant to water and corrosive chemicals typically associated with a water amusement park. Participant identifiers may be at least partially formed from materials that are not typically thought of as resistant to water and/or chemicals, however, in some embodiments materials such as these may be treated with anticorrosive coatings. In certain embodiments, participant identifiers may be formed at least partially from polymers.

In some embodiments, a participant identifier may be brightly colored. Bright colors may allow the identifier to be more readily identified and/or spotted. For example, if the identifier becomes decoupled from a participant the identifier may be more easily spotted if the identifier is several feet or more under water. In some embodiments, a participant identifier may include a fluorescent dye. The dye may be embedded in a portion of the participant identifier. The dye may further assist in spotting a lost participant identifier under water and/or under low light level conditions (e.g., in a covered water slide).

Figure 13:
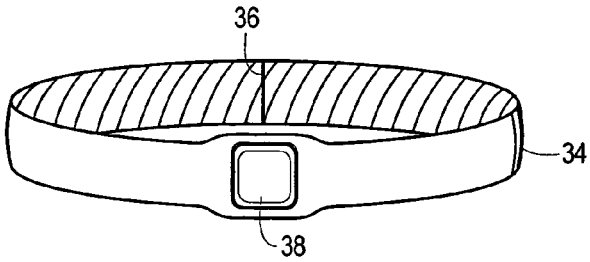
FIG. 13 depicts an embodiment of a participant identifier.

FIG. 13 depicts an embodiment of a participant identifier. Participant identifier 34 may be a wrist band as depicted in FIG. 13. Participant identifier 34 may include locking mechanism 36. Locking mechanism 36 may be positioned internally in participant identifier 34 as depicted in FIG. 13. Locking mechanism 36 may function so that only water park operators can remove participant identifier 34. This may reduce the chance of participant identifier 34 being lost.

In certain embodiments, a participant identifier may be operable by the participant to perform actions or obtain information. As shown in FIG. 13, participant identifier 34 includes interactive point 38. Interactive point 38 may be a display screen, a touch screen, and/or a button. Interactive point 38 may allow a participant to send a signal with participant identifier 34 so as to activate and/or interact with a portion of an amusement park (e.g., an interactive game). Interactive point 38 may display relevant data to the participant (e.g., time until closing of the park, amount of electronic money stored on the wrist band, and/or participant location in the waterpark).

Other components which may be incorporated into a participant identifier system are disclosed in the following U.S. patents, herein incorporated by reference: a personal locator and display system as disclosed in U.S. Pat. No. 4,225,953; a personal locator system for determining the location of a locator unit as disclosed in U.S. Pat. No. 6,362,778; a low power child locator system as disclosed in U.S. Pat. No. 6,075,442; a radio frequency identification device as disclosed in U.S. Pat. No. 6,265,977; and a remote monitoring system as disclosed in U.S. Pat. No. 6,553,336.

In some embodiments, participant identifiers may be used as part of an automated safety control system. Participant identifiers may be used to assist in determining and/or assessing whether a participant has been separated from their vehicle. Sensors may be positioned along portions of a water amusement park. For example sensors may be placed at different intervals along a water amusement ride. Intervals at which sensors are placed may be regular or irregular. Placement of sensors may be based on possible risk of a portion of a water amusement ride. For example, sensors may be placed with more frequency along faster moving portions of a water amusement ride where the danger for a participant to be separated from their vehicle is more prevalent.

In some embodiments, vehicle identifiers may be used to identify a vehicle in a water amusement park. The vehicle identifier may be used to identify the location of the vehicle. The vehicle identifier may be used to identify the type of vehicle. For example, the vehicle identifier may be used to identify how many people may safely ride in the vehicle.

In some embodiments, sensors near an entry point of a portion of a water amusement ride may automatically assess a number of participant identifiers/participants associated with a particular vehicle. Data such as this may be used to assess whether a participant has been separated from their vehicle in another portion of the water amusement ride.

In some embodiments, an operator may manually input data into a control system. Data input may include associating particular participant identifier(s) and/or the number of participants with a vehicle.

In some embodiments, a combination of automated and manual operation of a safety control system may be used to initially assess a number of participants associated with a vehicle. For example, an operator may provide input to initiate a sensor or a series of sensors to assess the number of participants associated with the vehicle. The assessment may be conducted at an entry point of a water amusement ride.

In certain embodiments, participant identifiers may be used in combination with a recording device. The recording device may be positioned in a water amusement park. One or more recording devices may be used throughout the water amusement park. The participant identifier may be used to activate the recording device. The participant identifier may be used to remotely activate the recording device. The recording device may include a sensor as described herein. The identifier may automatically activate the recording device upon detection by the sensor coupled to the recording device. The participant may activate the recording device by activating the participant identifier using participant input (e.g., a mechanical button, a touch screen). The participant identifier may activate one or more recording devices at one or more different times and/or timing sequences. For example several recording devices may be positioned along a length of a downhill slide. A participant wearing a participant identifier may activate (automatically or upon activation with user input) a first recording device positioned adjacent an entry point of the slide. Activating the first recording device may then activate one or more additional recording devices located along the length of the downhill water slide. Recording devices may be activated in a particular sequence so as to record the participant progress through the water slide.

In some embodiments, a recording device may record images and/or sound. The recording device may record other data associated with recorded images and/or sound. Other data may include time, date, and/or information associated with a participant wearing a participant identifier. The recording device may record still images and/or moving (i.e., short movie clips). Examples of recording devices include, but are not limited to, cameras and video recorders.

In some embodiments, a recording device may be based on digital technology. The recording device may record digital images and/or sound. Digital recording may facilitate storage of recorded events, allowing recorded events to be stored on magnetic media (e.g., hard drives, floppy disks, etc . . . ). Digital recordings may be easier to transfer as well. Digital recordings may be transferred electronically from the recording device to a control system and/or processing device. Digital recordings may be transferred to the control system via a hard-wired connection and/or a wireless connection.

Upon recording an event, the recording device may transfer the digital recording to the control system. The participant may purchase a copy of the recording as a souvenir. The participant may purchase a copy while still in a water amusement park, upon exiting the water amusement park, and/or at a later date. The control system may print a hard copy of the digital recording. The control system may transfer an electronic copy of the recorded event to some other type of media that may be purchased by the participant to take home with them. The control system may be connected to the Internet. Connecting the control system to the Internet may allow a participant to purchase a recorded event through the Internet at a later time. A participant may be able to download the recorded event at home upon arranging for payment.

In some embodiments, participant identifiers may be used in combination with sensors to locate a position of a participant in a water amusement park. Sensors may be positioned throughout the water park. The sensors may be connected to a control system. Locations of sensors throughout the water park may be programmed into the control system. The participant identifier may activate one of the sensors automatically when it comes within a certain proximity of the sensor. The sensor may transfer data concerning the participant (e.g., time, location, and/or identity) to the control system.

In some embodiments, participant identifiers may be used to assist a participant to locate a second participant. For example, identifiers may assist a parent or guardian to locate a lost child. The participant may consult an information kiosk or automated interactive information display. The interactive display may allow the participant to enter a code, name, and/or other predetermined designation for the second participant. The interactive display may then display the location of the second participant to the participant. The location of the second participant may be displayed, for example, as an icon on a map of the park. Security measures may be taken to ensure only authorized personnel are allowed access to the location of participants. For example, only authorized personnel (e.g., water park staff) may be allowed access to interactive displays and/or any system allowing access to identity and/or location data for a participant. Interactive displays may only allow participants from a predetermined group access to participant data from their own group.

In some embodiments, participant identifier may be used to assist in regulating throughput of participants through portions of a water amusement park. Participant identifiers may be used in combination with sensors to track a number of participants through a portion of the water amusement park. Keeping track of numbers of participants throughout the water park may allow adjustments to be made to portions of the water park. Adjustments made to portions of the water park may allow the portions to run more efficiently. Adjustments may be at least partially automated and carried out by a central control system. Increasing efficiency in portions of the water park may decrease waiting times for rides.

In some embodiments, sensors may be positioned along one or both sides of a floating queue line. Sensors in floating queue lines may be able to assist in detecting participants wearing participant identifiers. Data including about participants in the floating queue lines may be transferred to a control system. Data may include number of participants, identity of the participants, and/or speed of the participants through the floating queue lines. Based on data collected from the sensors, a control system may try to impede or accelerate the speed and/or throughput of participants through the floating queue line as described herein. Adjustment of the throughput of participants through the floating queue lines may be fully or partially automated. As numbers of participants in a particular ride increase throughput may decrease. In response to data from sensors the control system may increase the flow rate of participants to compensate. The control system may automatically notify water park staff if the control system is not able to compensate for increased flow rate of participants.

Figure 8:
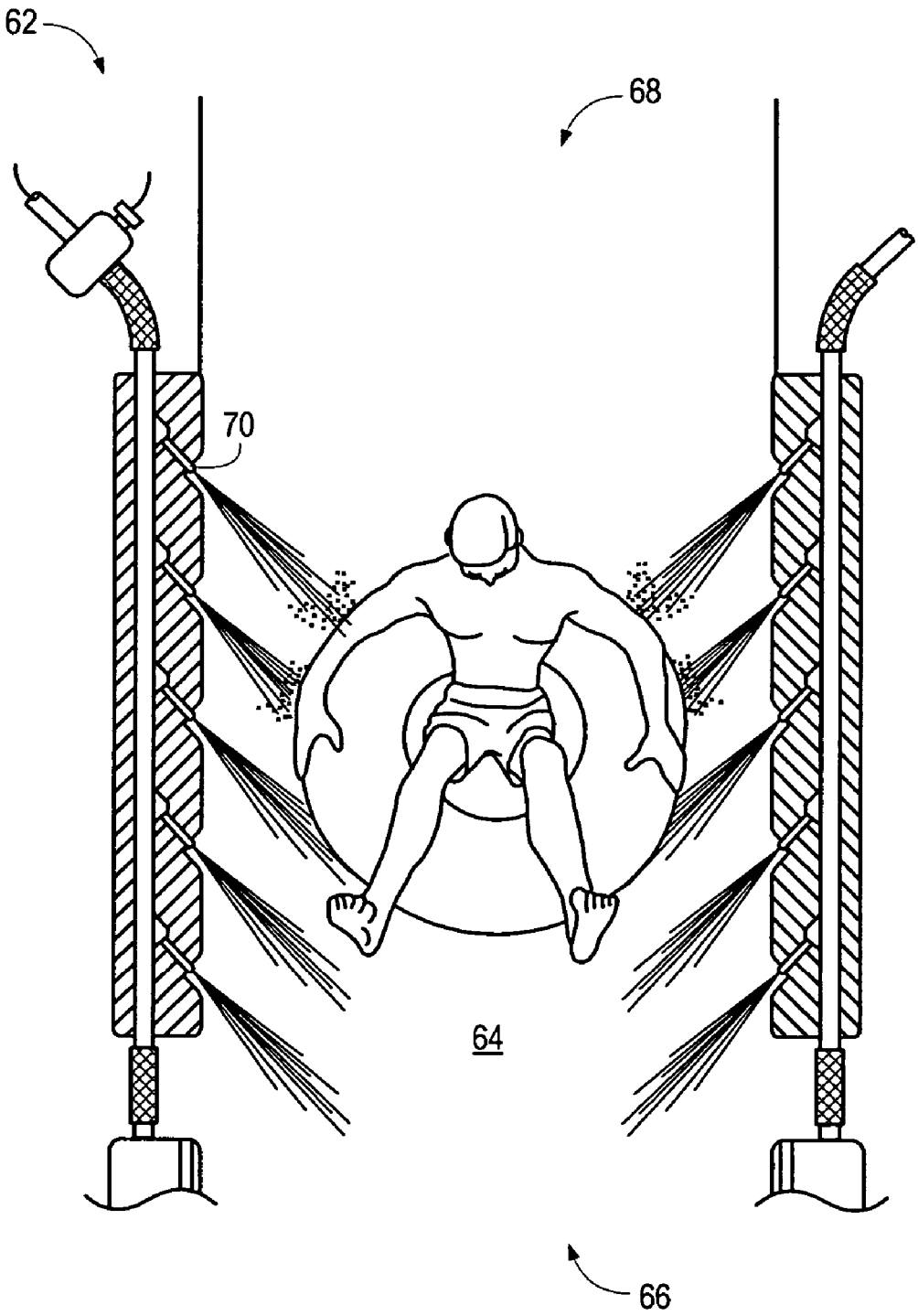
FIG. 8 depicts an embodiment of a floating queue line with jets.

In certain embodiments (an example of which is depicted in FIG. 8), floating queue system 62 includes a queue channel 64 coupled to a water ride at a discharge end 66 and coupled to a transportation channel on the input end 68. The channel 64 contains enough water to allow riders to float in the channel 64. The channel 64 additionally comprises high velocity low volume jets 70 located along the length of the channel 64. The jets are coupled to a source of pressurized water (not shown). Riders enter the input end 68 of the queue channel 64 from the coupled transportation channel, and the jets 70 are operated intermittently to propel the rider along the channel at a desired rate to the discharge end 66. This rate may be chosen to match the minimum safe entry interval into the ride, or to prevent buildup of riders in the queue channel 64. The riders are then transferred from the queue channel 64 to the water ride, either by a sheet flow lift station (as described previously) or by a conveyor system (also described previously) without the need for the riders to leave the water and/or walk to the ride. Alternatively, propulsion of the riders along the channel 64 may be by the same method as with horizontal hydraulic head channels; that is, by introducing water into the input end 68 of the channel 64 and removing water from the discharge end 66 of the channel 64 to create a hydraulic gradient in the channel 64 that the riders float down. In this case, the introduction and removal of water from the channel 64 may also be intermittent, depending on the desired rider speed.

In some embodiments, participant identifiers may be used with interactive games. Interactive games may include interactive water games. Interactive games may be positioned anywhere in a water amusement park. Interactive games may be positioned along a floating queue line, an elevation system, and/or a water ride. Interactive games positioned along portions of the water amusement park where delays are expected may make waiting more tolerable or even pleasurable for participants.

An interactive water game including a control system as described above may include a water effect generator; and a water target coupled to the control system. In some embodiments, the water effect generator may include a water cannon, a nozzle, and/or a tipping bucket feature. The water effect generator may be coupled to a play structure. During use a participant may direct the water effect generator toward the water target to strike the water target with water. A participant may direct the water effect using a participant identifier to activate the water effect generator. Upon being hit with water, the water target may send an activation signal to the control system. Upon receiving an activation signal from the water target, the control system may send one or more control signals to initiate or cease predetermined processes.

The water target may include a water retention area, and an associated liquid sensor. In some embodiments, the liquid sensor may be a capacitive liquid sensor. The water target may further include a target area and one or more drains. The water target may be coupled to a play structure.

In some embodiments, the interactive water game may include one or more additional water effect generators coupled to the control system. Upon receiving an activation signal from the water target, the control system may send one or more control signals to the additional water effect generator. The additional water effect generator may be configured to create one or more water effects upon receiving the one or more control signals from the control system. For example, the one or more water effects created by the additional water effect generator may be directed toward a participant. The additional water effect generator may include, but is not limited to: a tipping bucket feature, a water cannon, and/or a nozzle. The additional water effect generator may be coupled to a play structure.

A method of operating an interactive water game may include applying a participant signal to an activation point associated with a water system. The participant signal may be fully automated and originate from a participant identifier. The participant signal may be activated when a participant wearing the participant identifier positions themselves in predetermined proximity of the activation point. Participant input may activate the participant signal using the participant identifier. An activation signal may be produced in response to the applied participant signal. The activation signal may be sent to a control system. A water system control signal may be produced in the control system in response to the received activation signal. The water system control signal may be sent from the control system to the water system. The water system may include a water effect generator. The water effect generator may produce a water effect in response to the water system control signal. The water effect generator may be directed toward a water target to strike the water target with water. An activation signal may be produced in the water target, if the water target is hit with water. The water target may send the activation signal to the control system. A control signal may be produced in the control system in response to the received water target activation signal. In some embodiments, the interactive water game may include an additional water effect generator. The control system may direct a control signal to the additional water effect generator if the water target is struck by water. The additional water effect generator may include, but is not limited to: a water cannon, a nozzle, or a tipping bucket feature. The additional water effect generator may produce a water effect in response to a received control signal. The water effect may be directed toward a participant.

Figure 14:
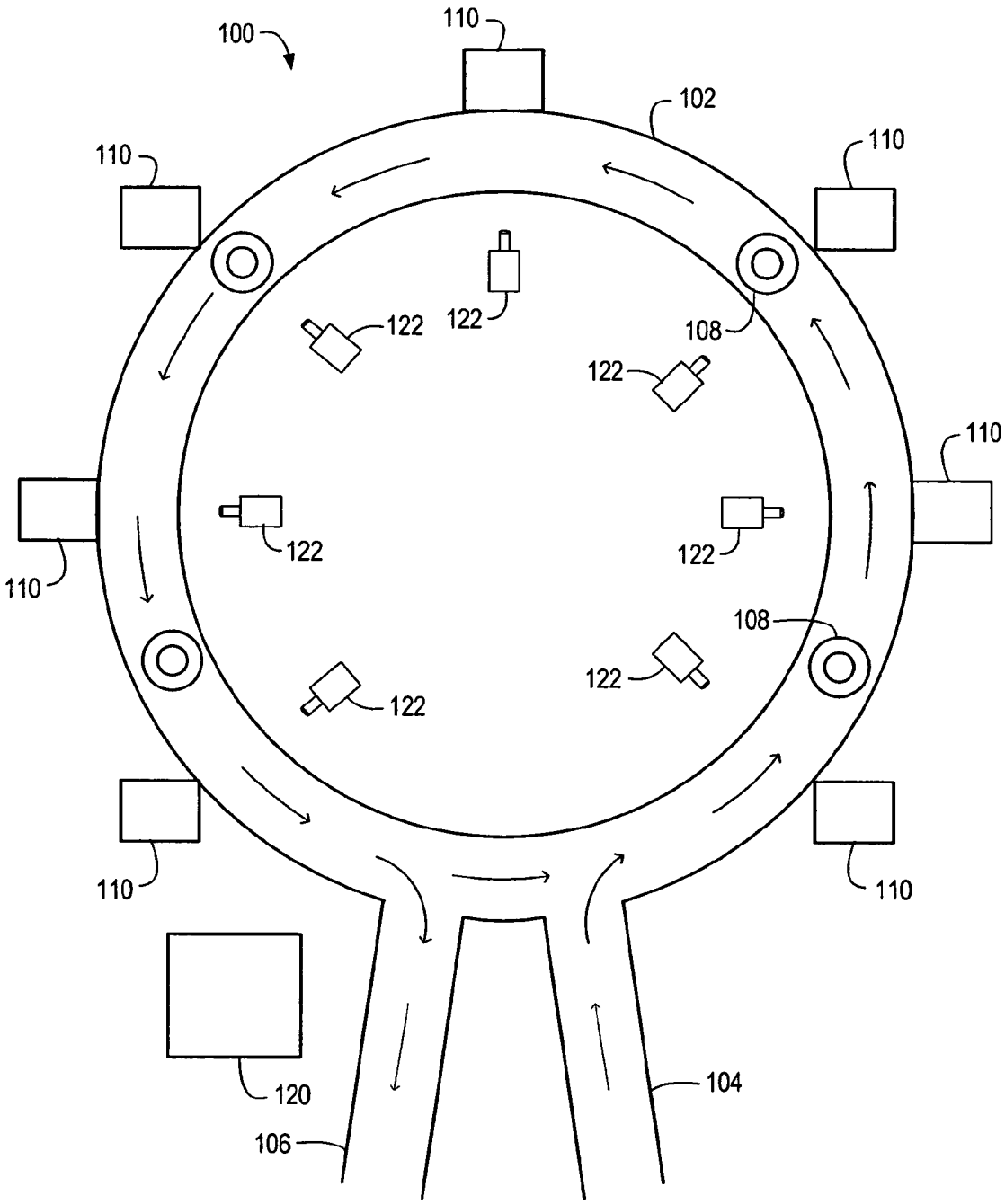
FIG. 14 depicts an embodiment of a competition area with one or more objectives for the participant to attempt.
Figure 15:
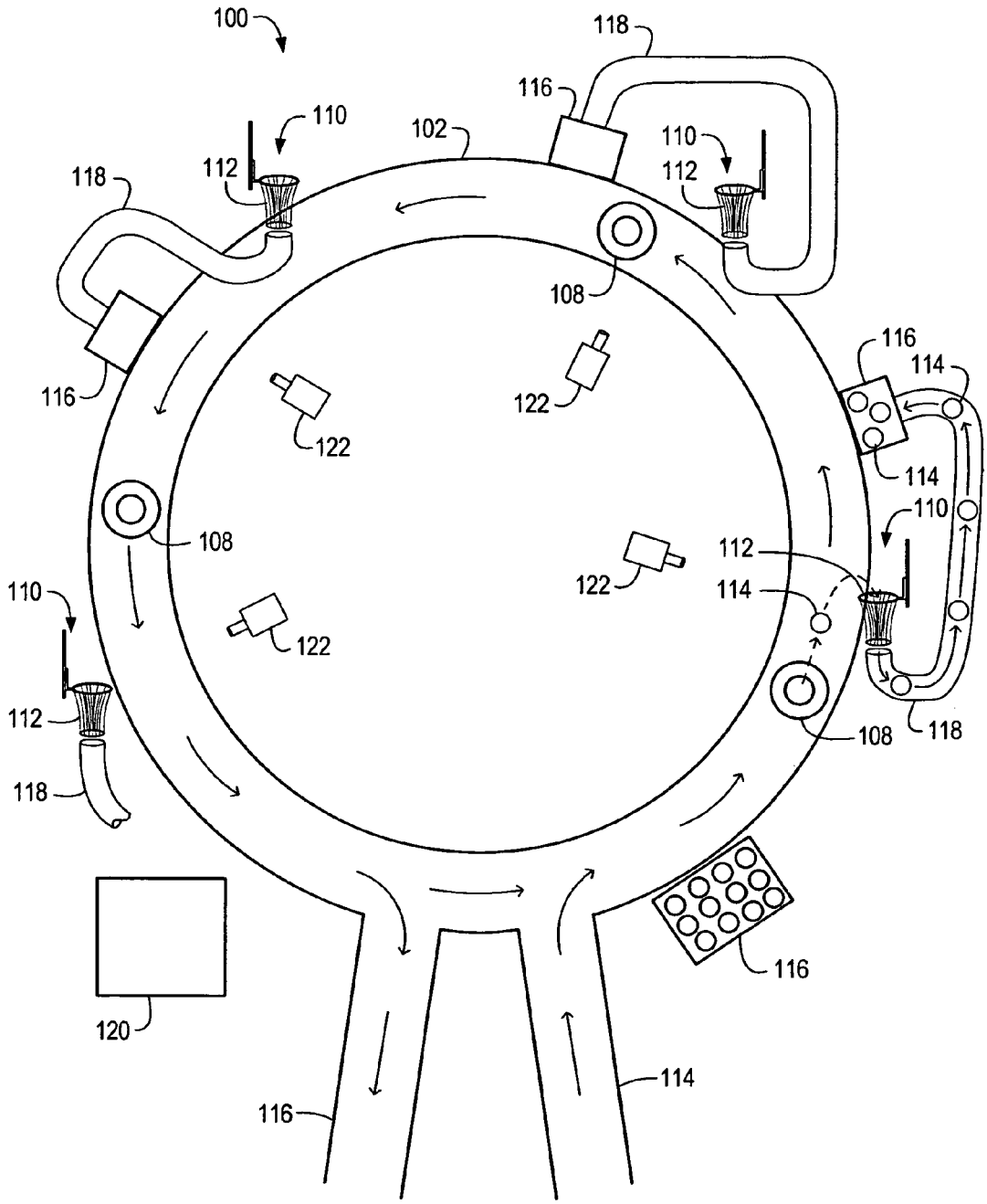
FIG. 15 depicts an embodiment of a competition area with a competition that includes directing an object through an opening.

In certain embodiments, an interactive game includes a competition area. A competition area may be part of a water ride. FIGS. 14 and 15 depict embodiments of a competition area in which participants may participate in a competition. FIG. 14 depicts an embodiment of a competition area with one or more objectives for the participant to attempt. FIG. 15 depicts an embodiment of a competition area in which the objectives include directing an object through an opening. Competition area 100 includes body of water 102. Body of water 102 may be a channel of water that runs in a continuous loop. Body of water 102 may be a circular channel of water as shown in FIGS. 14 and 15. Body of water 102 may, however, have any variety of regular or irregular shapes (e.g., elliptical, rectangular, or square) that comprises a path or a loop for a participant to travel through. In some embodiments, body of water 102 may be a natural body of water (e.g., a river or a stream). In certain embodiments, body of water 102 includes a flow or current of water that assists in or directs movement of a participant through competition area 100 (as shown by the arrows in FIGS. 14 and 15). Body of water 102 includes at least one entry point 104 and at least one exit point 106. In some embodiments, body of water 102 includes more than one entry point 104 and/or more than one exit point 106. In some embodiments, entry point 104 and exit point 106 are combined into a single exit/entry point. In some embodiments, entry point 104 and/or exit point 106 include gates to inhibit movement into or out of competition area 100.

In certain embodiments, a participant moves through competition area 100 on or using flotation device 108. Flotation device 108 may be, for example, an inner tube or a raft. In some embodiments, a participant may swim or float through competition area 100 without a flotation device. In certain embodiments, flotation devices may be powered (e.g., electric motor boats). In one embodiment, a flotation device is a surfboard that a participant rides while attempt objectives (e.g., tossing balls through an opening). In one embodiment, a flotation device includes a device used to play a game (e.g., a water cannon, a laser gun).

A participant may move through competition area 100 to attempt one or more objectives 110. Objectives 110 may include, but not be limited to, directing an object through an opening (e.g., a hoop), hitting one or more targets, displacing (e.g., knocking down) one or more pins from a set of pins with an object, or another physical test of skill. Targets that may be hit by a participant include, but are not limited to, laser targets hit using a laser device (e.g., a laser gun handheld by the participant or attached to flotation device 108) and targets hit by an object. In some embodiments, targets include other participants in competition area 100. A set of pins that is knocked down by an object may include, but not be limited to, a set of bowling pins on a bowling lane (e.g., a floating bowling lane) or a set of pins hanging from, for example, strings or other means. In some embodiments, interactive games may be arcade games. Examples of arcade games include tossing rings on bottles, scooping rubber ducks with a net, shooting duck targets, or operating a crane to pick up prizes.

In an embodiment, objective 110 includes opening 112, as shown in FIG. 15, through which the participant attempts to throw one or more objects 114. Opening 112 may, in certain embodiments, be a hoop. Objects 114 may be, for example, balls or any other object that may go through opening 112. In certain embodiments, objects 114 are substantially non-absorbent objects so that the objects do not absorb water during use. In some embodiments, objects 114 may float so that the objects are easily retrievable and/or are movable using a water based system. In some embodiments, objects 114 may include object identifiers for assessing a status of the objects. The object identifiers may be used in combination with participant identifiers and/or other identifiers to assess a status of the participant in competition area 100. For example, the object identifier may trigger a signal in opening 112 when object 114 passes through the opening to generate a positive score for a participant identified using a participant identifier.

In FIG. 15, a participant may pick up object 114 at object dispenser 116 after the participant enters competition area 100. Object dispenser 116 may include an opening from which the participant retrieves object 114. The opening may limit the participant to picking up only one object 114. In some embodiments, object dispenser 116 may require the participant to pay for picking up the object. The participant may pay for the object, for example, through the use of a participant identifier. For example, a sensor may detect the presence of a participant identifier and dispense object 114 to the participant. The cost of dispensing object 114 may be automatically deducted from or charged to an account associated with the participant identifier.

After the participant directs object 114 at opening 112, the object may be collected in object return 118. Object return 118 delivers object 114 to object dispenser 116 downstream of opening 112. Object return 118 may be, for example, a water channel with a flow of water that moves objects 114 from opening 112 to object dispenser 116. Object return 118 may return objects 114 in various other manners known to one skilled in the art. In some embodiments, object return 118 may use a conveyor belt mechanism to return objects 114 to object dispenser 116. In some embodiments, object return 118 may use a system of fluid jets to return objects 114 to object dispenser 116. Fluid jets may employ any fluid (e.g., gasses, liquids) such as water or air. In some embodiments, object return 118 may use gravity to return objects 114 to object dispenser 116. Opening 112 may be positioned at higher elevation relative to object dispenser 116 such that objects 114 may follow a path from opening 112 to object dispenser using gravity as a propelling force. In some embodiments, a combination of systems may be employed to facilitate delivery of objects 114 from opening 112 to object dispenser 116. Choice of systems employed for delivery may be dependent upon a number of factors (e.g., distance). In certain embodiments, object 114 is delivered to object dispenser 116 before the participant reaches the object dispenser. Thus, the participant may retrieve the same object for an attempt at the next opening 112 downstream. In some embodiments, the participant retrieves any object 114 from object dispenser 116 regardless of whether the object was used by the participant or another participant. After the final opening 112 in competition area 100, object return 118 may deliver objects 114 to the initial object dispenser 116 at the beginning of the competition area 100.

In FIGS. 14 and 15, a status of a participant in competition area 100 may be displayed on display 120. Display 120 may include information such as a score of the participant, scores of other participants, score of a team of participants, and/or a time of the competition (e.g., elapsed time or time remaining). Display 120 may include any information desired depending on the type of competition being attempted in competition area 100. Display 120 may be coupled to a monitoring system that assesses a status of participants in competition area 100. In certain embodiments, display 120 is an electronic display. In some embodiments, display may be a wet pencil scoring board operated manually by participants or an observer (e.g., a referee).

A status of a participant in competition area 100 may be assessed by an automated system. In certain embodiments, an automated system includes a monitoring system and one or more sensors. The monitoring system may be coupled to the one or more sensors in competition area 100. Sensors may be electronic sensors. Sensors include, but are not limited to, sensors that detect identifiers (e.g., participant identifiers, object identifiers, and/or objective identifiers), sensors coupled to or used in combination with an objective such as sensors that detect attempts at and/or completion of an objective (e.g., electronic sensors that track targets hit by an object, detect an object passing through an opening, or detect a number of pins displaced by an object), and other sensors such as timing sensors, water flowrate sensors, emergency sensors, etc. In certain embodiments, the monitoring system assesses the status of one or more participants in competition area 100. The monitoring system may assess a status of each participant individually and/or a status of one or more teams in the competition area. Status of participants and/or teams in competition area 100 may be displayed on display 120.

In some embodiments, participant identifiers may be used to monitor compliance with game rules. For example, participant identifiers may be used to record when a player has left the designated playing area (e.g., gone out of bounds) or when a team has too many players in the competition area. In certain embodiments, a participant identifier may be used to determine when a participant has used up an allotted time or number of attempts in a competition area, or should otherwise exit a water ride or competition area. For example, a participant identifier may be programmed to indicate that a participant paid for 50 attempts in a hoops game. When the control system indicates that the participant has reached 50 attempts, the control system may discontinue serving balls to the participant until the participant purchases more attempts and/or provide a visual or audio indicator to the participant that the participant has used up its attempts. In some embodiments, a participant identifier may be operable to allow a participant to purchase more attempts. For example, a participant may purchase more attempts by entering credit card information or authorizing additional charges or a credit card account saved in the participant identifier device. In some embodiments, a participant identifier or other control device may be operable by a participant to select various parameters of competition, such as the degree of difficulty (e.g., height of a hoop or a distance to a target).

Competition area 100 may include one or more cameras 122. Cameras 122 may be used to monitor participants and/or competition in competition area 100. In certain embodiment, cameras 122 include sensors that identify identifiers (e.g., participant identifiers, object identifiers) in competition area 100. In some embodiments, cameras 122 are coupled to and/or used in combination with sensors to assess a status of participants in competition area 100. In some embodiments, cameras 122 are coupled to other sensors (e.g., electronic sensors that track targets hit by an object, detect an object passing through an opening, or detect a number of pins displaced by an object) used in competition area 100. Cameras 122 may be coupled to a monitoring system to assess a status of participants in competition area 100. In some embodiments, cameras 122 may be used to broadcast (e.g., televise or simulcast) the competition in competition area 100. In some embodiments, competition area 100 may include one or more observation areas for observing participants. An observation area may include, for example, bleachers for observers. In some embodiments, a competition or water ride may be sponsored. Sponsor advertising may be displayed to a participant, a live audience, or a broadcast audience using signs, electronic displays, or broadcast methods.

In certain embodiments, a participant competes for an individual score in competition area 100. The individual score may be a score, for example, for one pass through competition area 100 or for a specified period of time in competition area 100. The individual score of a participant may be tracked by the monitoring system and/or a tracking system coupled to the monitoring system over a duration of time (e.g., days, months, or years) or a number of passes through competition area 100. The score of the participant over the duration of time or number of passes may be compared to scores of other participants. One or more scores (e.g., high scores) over the duration of time or number of passes may be rewarded with prizes or other rewards.

In some embodiments, a plurality of participants compete as two or more teams against each other. Scores for a participant and/or a team may be tracked for a competition. A competition may include one pass through competition area 100 for a participant or a team of participants or any other predetermined amount of passes or times for the participant or the team of participants. In some embodiments, a competition includes a tournament (e.g., bracket play involving multiple teams) or a league (e.g., scheduled league play over multiple days of competition). In some embodiments, referees (e.g., human referees) are used to observe and regulate a competition. In some competitions, participants are allowed to pass objects between participants and/or block shots of competing participants. In some embodiments, observers may be allowed to bet on results of one or more competitions occurring in competition area 100 (e.g., competitions in the competition area may be bet on as part of a sports book).

Figure 16:
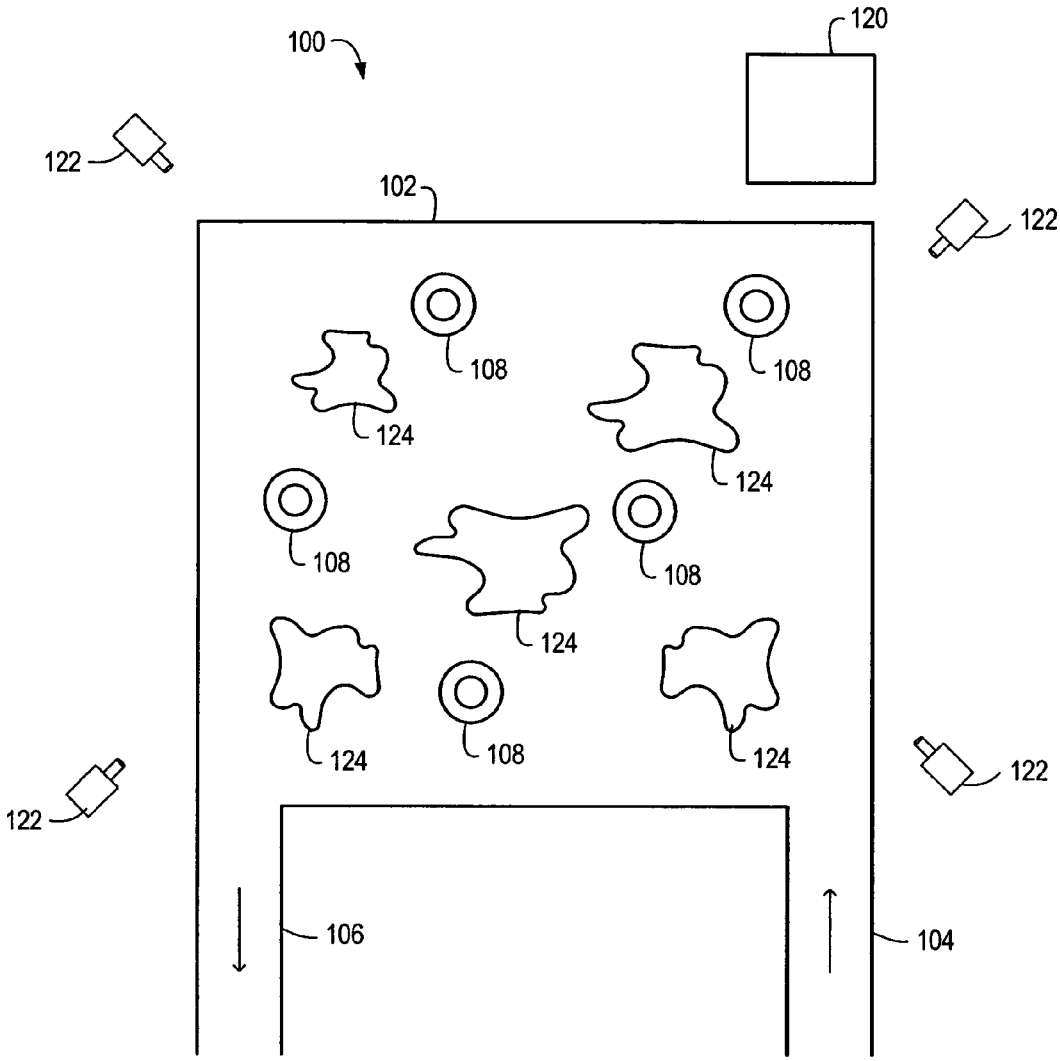
FIG. 16 depicts an embodiment of a rectangular competition area in which two or more participants compete against each other.

FIG. 16 depicts an embodiment of a rectangular competition area in which two or more participants compete against each other. Competition area 100 includes rectangular body of water 102. Body of water 102 may be a pool-like area (e.g., a water-filled basin) or other body of water in which participants (e.g., participants on flotation devices 108) move freely. In certain embodiments, body of water 102 is a substantially stationary body of water (e.g., a body of water substantially free of current). In some embodiments, body of water 102 includes a directional current or other types of fluid motion. For example, body of water 102 may be a wave pool which is turned on, either periodically or constantly, during a competition. Participants in competition area 100 may be allowed to move in any direction physically possible by the participant during the competition. In some embodiments, body of water 102 includes one or more obstacles 124. Obstacles 124 may inhibit movement of participants in body of water 102 and/or used by the participants during competition as shelter from opponents. Examples of obstacles 124 include, but are not limited to, islands, walls, caves, or ramps.

In certain embodiments, competition area 100 may include objectives (e.g., openings to direct objects through or targets to be hit by an object) for participants to attempt. In an embodiment, participants in competition area 100 compete against one another (either individually or in two or more teams) to hit each other with objects or a targeting device (e.g., a laser gun) in a war-type competition (e.g., a laser tag competition or a dodge ball competition). Such competitions may be single competitions or competitions involved in a tournament or league as described above.

In some embodiments, participants in competition area 100 may compete against automated systems. Systems controlled by automated control centers may respond automatically to participants based on various input devices (e.g., sensors) coupled to the control centers. For example, various automated laser guns or water cannons may be activated when participants enter a predetermined area or come within a predetermined range of a sensor coupled to an automated control center. In such a manner a participant and/or a team of participants may compete against a computer system. Teams may compete against one another, for example, in such a situation by comparing participant and/or team scores against each other.

In some embodiments, participants in competition area 100 may compete against water park employees. For example, water park employees may activate laser guns or water cannons when participants enter a predetermined area or come within a predetermined range of a water park employee. In such a manner a participant and/or a team of participants may compete against a standard opponent, which in this case are the water park employees. Teams may compete against one another, for example, in such a situation by comparing participant and/or team scores against each other.

In an embodiment, a system for water amusement may allow participants of a water ride to take part in a role-playing game. A role-playing game may involve establishing roles for one or more of the participants of a water ride. For example, one group of participants may be captain and crew of an eighteenth-century British military vessel, while another group of participants may be a captain and crew of a pirate ship. Participants may make various decisions and accomplish various objectives during the role-playing game. In some embodiments, the decisions made by the participants and/or the achievement of objectives may affect the direction or progress of the game or a water ride. For example, a team of participants may use a treasure map to navigate a series of waterways on a flotation device to get to a treasure chest. Different participants may have different powers or possess different information needed to successfully navigate the waterways. In some embodiments, a quest or role-playing game may be played at the location of a particular water ride. In other embodiments, a quest or role-playing game may be carried out at two or more water rides, or throughout an entire water park.

Role-playing games may have various themes. In one embodiment, a role-playing game has a fantasy theme (e.g., magic, mermaids, wizards, dragons). In another embodiment, a role-playing game has a science fiction theme (e.g., future world, aliens, etc.). Other examples of role-playing themes include historical themes (e.g., Vikings), legends, literature, casinos, safaris, and horror. In certain embodiments, water park employees may assume all the roles of a game, with the participants of the water ride observing or interacting with the water park employees. In certain embodiments, flotation devices may relate to a theme (e.g., a floating "horse" for a participant "cowboy").

In some embodiments, an interactive game system may include a device for randomly generating information, such as a state, decision, or path. For example, a device may determine whether the participant proceeds through a left water channel or a right water channel. In some embodiments, a physical object or objects such as a spinner, a die, or a deck of cards, may be used to generate the information. In other embodiments, a computer system may generate the information. In some embodiments, participants of a water ride may operate the device to determine the next step of an interactive game. For example, a participant may rotate a spinner having several spots. If a spinner lands on a certain spot, participants on a flotation device may be dropped down a slide into a body of water. In certain embodiments, an automatic control system may be used to implement a randomly generated state. For example, a control system may open a designated gate if a spinner is in a particular position.

In some embodiments, a role-playing game system may include sensors to monitor various aspects of play. For example, sensors may detect position or other status of participants of the game. The sensors may be coupled to a processing system that uses the information from the sensors to direct the flow of a game. For example, if a group of participants are in a prohibited location, an automated system may generate instructions to the participants (e.g., audio or video instructions) to move to a different location. In some embodiments, the sensors may detect participant identifiers, object identifiers, vehicle identifiers, or a combination thereof.

In some embodiments, the actions or achievements of one participant or group of participants may affect the possibilities or outcome for another participant or group of participants. In one embodiment, a first team reaching an objective may make competing team's progress more difficult. For example, a first team shooting a cannonball through a window may cause a gate to close on a second team. As another example, a first team reaching an objective may cause the other team's water cannon to be disabled or turned down. As yet another example, a team may defeat its opponents by moving an object to a designated location. U.S. Pat. No. 5,011,161, incorporated herein by reference, describes a submarine game in which a team wins by driving an overhanging boat-shaped target into its opponent's space using a stream from a water cannon.

In some embodiments, a role-playing game may have a gamemaster. The gamemaster may determine some or all of the operating parameters of the game. For example, the gamemaster may assign roles to be played by the participants, determine objectives or quests to be achieved or actions to be taken, assess performance of the participants, and the like. A gamemaster may serve as a story creator, director, referee, or combination thereof. In one embodiment, the gamemaster is one or more guests of a water park. In another embodiment, the gamemaster is water park employee.

In an embodiment, a gamemaster for a role-playing game is provided through an automated system. The automated system may be programmed to provide information and to control various aspects of play of the game and/or the water ride. In certain embodiments, a gamemaster is provided through a computer program running on a personal computer. A computer system operating as a gamemaster may eliminate a need for physical objects such as cards, dice, and tokens to play a role-playing game. In certain embodiments, however, a role-playing game may include the use of such physical objects.

Figure 17:
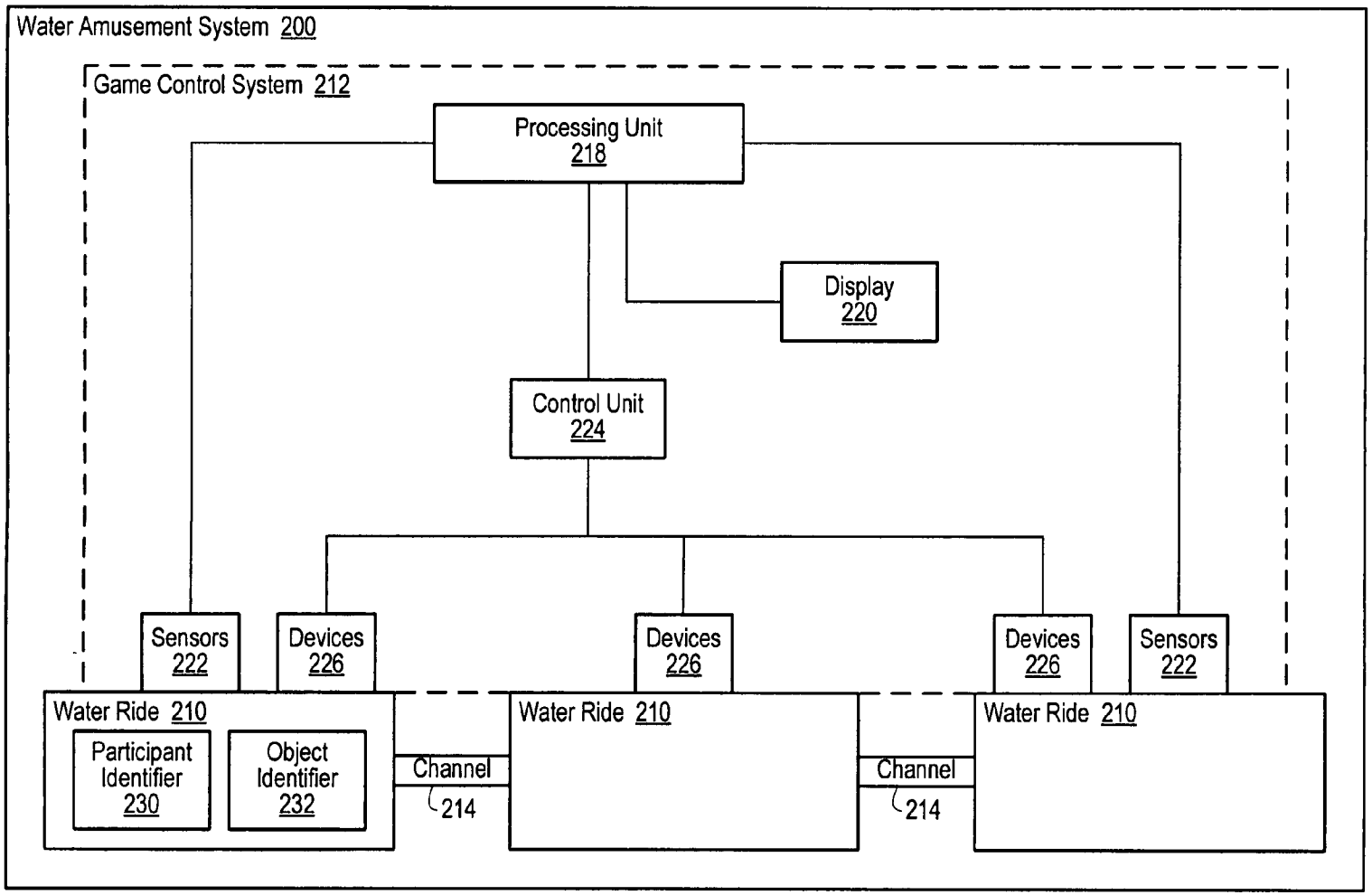
FIG. 17 depicts a block diagram of a water amusement system including a game control system.

FIG. 17 depicts a block diagram of water amusement system 200. Water amusement system 200 may include water rides 210 and game control system 212. Water rides 210 may be connected by water channels 214. Water rides 210 may include one or more objectives 216. Game control system 212 may include processing unit 218, display 220, sensors 222, control unit 224, and devices 226. Display 220, sensors 222, and control unit 224 may be coupled to processing unit 218. Devices 226 may be coupled to control unit 224. Devices 226 may include various mechanisms or elements used in a water ride or an interactive game. Examples of devices for a game system include gates, ball-return mechanisms, water cannons, fountains, and doors.

Display 220 may be any of various components that provide visual information to a participant. In one embodiment, display 220 is a projection screen. In another embodiment, display 220 is a hand-held wireless display device. Display 220 may include various other visual indicators such as lamps, LEDs, mechanical scoreboards, wheels, or flags. In certain embodiments of a game control system, an audio system such as a public address system may be used to provide information to the participants instead of, or in addition to, information provided on a display. In some embodiments, displays may be provided at one or more designated information terminals in a water park.

In some embodiments, sensors 222 may provide data for use by processing unit 218 in monitoring and controlling the play of a role-playing game. For example, sensors 222 may detect a position of participant identifiers 230 and objective identifiers 232. Processing unit 218 may use the position data received from sensors 222 to make decisions related to the progress of a game. For example, processing unit 218 may use the position of one of participant identifiers 230 and object identifiers 232 determine that a particular participant has achieved a particular objective (e.g., thrown a ball through a ring, turned a key to unlock a treasure chest). Once an objective is achieved, processing unit 218 may cause one of devices 226 to perform an appropriate action (to activate a motor to open a gate, turn on a water hose, display the next objective, etc.) In some embodiments, a processing unit may use information from sensors to determine when that a particular participant is in front a display. Upon identifying the participant, the processing unit may display the appropriate instructions (e.g., the next clue), status, or other information for the participant. In certain embodiments, the participant may activate the processing unit by activating a control device (e.g., a button on the participant's wristband).

In certain embodiments, a game control system is used to produce, control, or monitor a role-playing game. A computer system may serve as a gamemaster for the role-playing game. For example, the computer system may assign roles to participants, select weapons for the participants, define quests, and monitor progress of the game. In other embodiments, a game control system may be used to produce, control or monitor other games, such as games of physical skill (e.g., hoops games, laser tag, golf, water golf), intellectual skill (e.g., trivia quiz), or a combination thereof (e.g., navigating a water maze).

In an embodiment, a processing unit for a game control system may be provided on a personal computer system. In some embodiments, the computer system is located at the site of the water ride. In other embodiments, the computer system is located at a remote site from the water ride, and connected by a wired or wireless network to the sensors, devices, and controls at or near a water ride. In one embodiment, a single computer system controls two or more different games.

In an embodiment, a game system allows participants of a water ride to participate in a fantasy sports game. The participants may be a leader of a team (e.g., coach, quarterback, team captain). Players on the teams may include participants of the water ride, "virtual" participants generated by the computer, or a combination of both. In some embodiments, an automated system may control the flow of the game (e.g., provide directions for taking actions during the game, keep score). In certain embodiments, a fantasy sports game may use historical, statistical, or real-time performance data (e.g., rushing yards, completed passes, home runs, wins) for making decisions in the interactive game. In one embodiment, data (e.g., real time athletic performance data) used in the game is received over a network (e.g., the internet).

In some embodiments, a participant may use a control device to take actions during an interactive game. A control device may be operated to perform various actions during a game, including but not limited to, starting a game, suspending a game, restarting a game, making a selection, monitoring a score, or recording a score. In some embodiments, a control device may be an electronic device. Examples of electronic devices include input/output devices such as keypads, keyboards, joysticks, monitor screens. In one embodiment, a participant may use a touch screen. A participant may enter commands by touching the screen.

Control devices may be suitable for use in a water park environment. Electronic components within a device may be sealed from moisture and contamination. In some embodiments, electronic components of a device are contained in a waterproof or water resistant case or enclosure. In certain embodiments, an electronic device may include a water resistant outer film, cover, or sleeve. For example, a device with a keypad may include a protective polymer panel over the keypad. In certain embodiments, a control device may include gaskets, caulk, or o-rings to seal gaps, crevices, or apertures in the device (e.g., between a touch screen and its casing). Packaging elements of control devices and identifiers may be made of various water resistant, corrosion resistant, and/or chemically resistant materials. Suitable materials may include, but are not limited to, polyurethane, polyethylene, polypropylene, titanium, or stainless steel. In certain embodiments, a control device may be integrated with a participant identifier (e.g., together on a single wristband), an objective identifier, or an object identifier.

In some embodiments, a control device may be a manual device. Examples of manual devices include levers, push rods, cables, triggers, or splash plates. In certain embodiments, a participant may use a manual device to operate an electronic control device. For example, a participant may use a push rod to control a display mode on an electronic display panel. In other embodiments, a participant may use an electronic device to operate a manual control device. For example, a participant may use an electronic controller to activate a "catapult" launcher arm.

In some embodiments, interactive games are coupled to other attractions or elements of a water park. In one embodiment, an interactive game area (e.g., a water channel with hoops) connects two water slides. In another embodiment, an interactive game area may be coupled to a water elevation device. In certain embodiments, a hoops game may be provided on a water slide, conveyor, or other portion of a ride. In some embodiments, an interactive game may include or be coupled to exercise devices. In one embodiment, participants may compete on exercise devices in or on a body of water.

In some embodiments, a body of water for an interactive game is coupled to a living area. In other embodiments, a body of water for an interactive game is coupled to a dining area. For example, a participant may order food and beverages at a first location on a water channel, play an interactive game at a second location on the water channel downstream from the first location, and pick up the participant's order at a third location on the water channel downstream from the second location. In one embodiment, a participant remains in a flotation device during ordering, playing, and dining. U.S. patent application Ser. Nos. 09/952,036 and 10/693,654 (Publication No. US-2005-0090318-A1), which are incorporated by reference as if fully set forth herein, describe various other water rides, attractions, and water park elements that may be coupled to an interactive game system.

In one embodiment, an interactive game system is coupled to one or more elevation increasing systems. The elevation increasing system carry participants between water amusement rides. In certain embodiments, the water amusement rides, elevation increasing systems, and interactive game system may be part of a closed loop entertainment system for a participant.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An interactive water amusement ride, comprising:

a water amusement ride;

a participant identifier coupled to a participant in the water amusement ride;

a competition area located in the water amusement ride, wherein the participant participates in a competition in the competition area;

one or more sensors coupled to the competition area, wherein at least one of the sensors is configurable to detect the participant identifier in the competition area; and one or more control systems coupled to the sensors, wherein at least one of the control systems is configurable to assess a status of the participant in the competition;

wherein the competition comprises one or more objectives for the participant to attempt, wherein at least one of the objectives comprises a first opening configured to accept one or more objects directed to the first opening by the participant, and wherein the first opening is coupled to a second opening downstream from the first opening, wherein the objects are transported from the first opening to the second opening, wherein the participant retrieves at least one of the objects from the second opening downstream of the first opening, wherein at least one of the objectives comprises at least a third opening downstream from the second opening, and wherein the third opening is configured to accept the object retrieved from the second opening.

2. The interactive water amusement ride of claim 1, wherein at least one of the objectives comprises an objective identifier, wherein the objective identifier is detected by one or more of the sensors.

3. The interactive water amusement ride of claim 1, wherein at least one of the objectives comprises the participant performing a physical test of skill.

4. The interactive water amusement ride of claim 1, wherein at least one of the objectives comprises the participant directing an object to an opening.

5. The interactive water amusement ride of claim 1, wherein at least one of the objectives comprises the participant hitting one or more targets.

6. The interactive water amusement ride of claim 5, wherein at least one of the targets comprises an electronic target coupled to at least one of the sensors.

7. The interactive water amusement ride of claim 1, wherein at least one of the control systems is configurable to assess the status of the participant in the competition by comparing the performance of the participant relative to one or more other participants.

8. The interactive water amusement ride of claim 1, wherein the participant is a member of a team of participants, and wherein the team is configured to compete against another team of participants in the competition area.

9. The interactive water amusement ride of claim 1, wherein at least one of the control systems is configurable to assess the status of the participant in the competition by assessing a score for the participant during a specified period of time.

10. The interactive water amusement ride of claim 1, wherein the competition area comprises a display configured to display the status of the participant in the competition.

11. The interactive water amusement ride of claim 1, further comprising one or more cameras configured to monitor the participant in the competition area, wherein the cameras are coupled to at least one control system.

12. The interactive water amusement ride of claim 1, wherein the competition area comprises a channel of water which runs in a continuous loop.

13. The interactive water amusement ride of claim 1, wherein the participant is configured to move through the competition area on a flotation device.

14. The interactive water amusement ride of claim 1, wherein the water amusement ride is coupled to a water amusement system.

15. The interactive water amusement ride of claim 1, wherein the competition area comprises an observation area configured for observation of the competition by one or more non-participants.

16. The interactive water amusement ride of claim 1, further comprising a first elevation increasing system configured to convey a participant from an exit point of the water amusement ride, or a point subsequent to such exit point, to an entry point of a second water amusement ride, or a point preceding such entry point, wherein the exit point of the water amusement ride and the entry point of the second water amusement ride are at different elevation levels.

17. The interactive water amusement ride of claim 16, further comprising a second elevation increasing system configured to convey a participant from an exit point of the second water amusement ride, or a point subsequent to such exit point, to another area of a water park.

18. The interactive water amusement ride of claim 1, wherein one or more of the control systems is configured to enforce compliance with one or more competition rules.

19. The interactive water amusement ride of claim 1, wherein assessing a status of the participant in the competition comprises monitoring compliance with competition rules.

20. An interactive water amusement ride, comprising:

a water amusement ride;

a participant identifier coupled to a participant in the water amusement ride;

a competition area located in the water amusement ride, wherein the participant participates in a competition in the competition area;

one or more sensors coupled to the competition area, wherein at least one of the sensors is configurable to detect the participant identifier in the competition area; and one or more control systems coupled to the sensors, wherein at least one of the control systems is configurable to assess a status of the participant in the competition;

wherein at least one of the objectives comprises a first opening configured to accept one or more objects directed to the first opening by the participant, and wherein the first opening is coupled to a second opening downstream from the first opening, wherein the objects are transported from the first opening to the second opening such that one or more of the objects are available to the participant when the participant floats down to the second opening.

21. The interactive water amusement ride of claim 20, wherein at least one of the control systems is configurable to assess the status of the participant in the competition by comparing the performance of the participant relative to one or more other participants.

22. The interactive water amusement ride of claim 20, wherein the participant is a member of a team of participants, and wherein the team is configured to compete against another team of participants in the competition area.

23. The interactive water amusement ride of claim 20, wherein at least one of the control systems is configurable to assess the status of the participant in the competition by assessing a score for the participant during a specified period of time.

24. The interactive water amusement ride of claim 20, wherein the competition area comprises a display configured to display the status of the participant in the competition.

25. The interactive water amusement ride of claim 20, wherein the competition area comprises a channel of water which runs in a continuous loop.

26. The interactive water amusement ride of claim 20, wherein the participant is configured to move through the competition area on a flotation device.

27. The interactive water amusement ride of claim 20, wherein the water amusement ride is coupled to a water amusement system.

28. The interactive water amusement ride of claim 20, further comprising a first elevation increasing system configured to convey a participant from an exit point of the water amusement ride, or a point subsequent to such exit point, to an entry point of a second water amusement ride, or a point preceding such entry point, wherein the exit point of the water amusement ride and the entry point of the second water amusement ride are at different elevation levels.

29. The interactive water amusement ride of claim 20, wherein one or more of the control systems is configured to enforce compliance with one or more competition rules.

30. The interactive water amusement ride of claim 29, further comprising a second elevation increasing system configured to convey a participant from an exit point of the second water amusement ride, or a point subsequent to such exit point, to another area of a water park.

* * * * *